US012214265B1

(12) United States Patent
Evans et al.

(10) Patent No.: US 12,214,265 B1
(45) Date of Patent: Feb. 4, 2025

(54) GOLF CLUB FACE PLATE HAVING CORRELATED CHARACTERISTIC TIME MEASUREMENT MAP

(71) Applicant: Cobra Golf Incorporated, Carlsbad, CA (US)

(72) Inventors: D. Clayton Evans, Vista, CA (US); Cameron J. Day, Vista, CA (US); Tim A. Beno, San Diego, CA (US); Steven M. Mitzel, San Marcos, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 280 days.

(21) Appl. No.: 17/400,911

(22) Filed: Aug. 12, 2021

Related U.S. Application Data

(60) Provisional application No. 63/121,351, filed on Dec. 4, 2020.

(51) Int. Cl.
*A63B 53/04* (2015.01)

(52) U.S. Cl.
CPC ..... *A63B 53/0458* (2020.08); *A63B 53/0466* (2013.01)

(58) Field of Classification Search
CPC ..... A63B 53/0458; A63B 53/0462; A63B 53/0466; A63B 53/047; A63B 53/0454
USPC ..... 473/324–350, 287–292
See application file for complete search history.

(56) References Cited

U.S. PATENT DOCUMENTS 2,034,936 A * 3/1936 Barnhart ..... A63B 53/047 473/331
5,601,501 A * 2/1997 Kobayashi ..... A63B 53/04 473/350
5,611,742 A * 3/1997 Kobayashi ..... A63B 60/52 473/331
5,665,013 A * 9/1997 Kobayashi ..... A63B 53/047 473/331
5,709,615 A * 1/1998 Liang ..... A63B 60/00 473/324
5,735,755 A * 4/1998 Kobayashi ..... A63B 53/04 473/331
6,290,609 B1 * 9/2001 Takeda ..... A63B 53/047 473/335
6,595,057 B2 7/2003 Bissonnette et al.
6,605,007 B1 8/2003 Bissonnette et al.
(Continued)

FOREIGN PATENT DOCUMENTS

WO 2018204932 A1 11/2018
WO 2019126775 A1 6/2019

*Primary Examiner* — Sebastiano Passaniti
(74) *Attorney, Agent, or Firm* — Quarles & Brady LLP

(57) ABSTRACT

A variable thickness face plate for a golf club head includes a peripheral edge having an upper peripheral edge and a lower peripheral edge, and a plurality of regions of constant thickness defined by an internal surface of the face plate. The plurality of regions of constant thickness include a first subset of regions of constant thickness being disposed along a first horizontally-extending path proximate the upper peripheral edge, the first horizontally-extending path being disposed radially inward from and parallel to the upper peripheral edge, and a second subset of regions of constant thickness being disposed along a second horizontally-extending path proximate the lower peripheral edge, the second horizontally-extending path being disposed radially inward from and parallel to the lower peripheral edge.

25 Claims, 12 Drawing Sheets

(56) References Cited

U.S. PATENT DOCUMENTS 6,645,087 B2 * 11/2003 Yabu ..... A63B 60/00 473/346
6,899,638 B2 5/2005 Iwata et al.
6,904,663 B2 6/2005 Willett et al.
6,960,142 B2 11/2005 Bissonnette et al.
7,018,305 B2 * 3/2006 Sugimoto ..... A63B 53/04 473/345
7,029,403 B2 4/2006 Rice et al.
7,041,003 B2 5/2006 Bissonnette et al.
7,101,289 B2 9/2006 Gibbs et al.
7,137,907 B2 11/2006 Gibbs et al.
7,140,975 B2 11/2006 Bissonnette et al.
7,163,468 B2 1/2007 Gibbs et al.
7,166,038 B2 1/2007 Williams et al.
7,169,059 B2 1/2007 Rice
7,169,060 B2 1/2007 Stevens et al.
7,207,898 B2 4/2007 Rice
7,214,142 B2 5/2007 Meyer
7,258,626 B2 8/2007 Gibbs et al.
7,261,643 B2 8/2007 Rice
7,278,927 B2 10/2007 Gibbs et al.
7,291,075 B2 11/2007 Williams et al.
7,297,072 B2 11/2007 Meyer et al.
7,306,527 B2 12/2007 Williams et al.
7,311,613 B2 12/2007 Stevens et al.
7,338,388 B2 3/2008 Schweigert et al.
7,347,794 B2 3/2008 Schweigert
7,361,099 B2 4/2008 Rice
7,367,899 B2 5/2008 Rice
7,390,269 B2 6/2008 Williams et al.
7,393,287 B2 * 7/2008 Huang ..... A63B 53/0466 473/332
7,407,448 B2 8/2008 Stevens et al.
7,410,428 B1 8/2008 Dawson et al.
7,413,519 B1 8/2008 Dawson et al.
7,413,520 B1 8/2008 Hocknell et al.
7,419,440 B2 9/2008 Williams et al.
7,419,442 B1 9/2008 Alan et al.
7,422,527 B2 9/2008 Rice
7,422,528 B2 9/2008 Gibbs et al.
7,431,664 B2 10/2008 Meyer
7,431,666 B2 10/2008 Vincent et al.
7,431,667 B2 10/2008 Vincent et al.
7,448,960 B2 11/2008 Gibbs et al.
7,455,598 B2 11/2008 Williams et al.
7,476,161 B2 1/2009 Williams et al.
7,488,261 B2 2/2009 Cackett et al.
7,494,424 B2 2/2009 Williams et al.
7,520,819 B2 4/2009 Rice et al.
7,537,528 B2 5/2009 Rice et al.
7,549,934 B2 6/2009 Rice
7,549,935 B2 6/2009 Foster et al.
7,553,242 B2 6/2009 Meyer et al.
7,559,851 B2 7/2009 Cackett et al.
7,568,982 B2 8/2009 Cackett et al.
7,575,524 B2 * 8/2009 Willett ..... A63B 53/047 473/345
7,578,751 B2 8/2009 Williams et al.
7,578,755 B2 8/2009 Oyama
7,584,531 B2 9/2009 Schweigert
7,588,501 B2 9/2009 Williams et al.
7,591,737 B2 9/2009 Gibbs et al.
7,614,964 B2 11/2009 Matsunaga
7,618,331 B2 11/2009 Hirano
7,637,822 B2 12/2009 Foster et al.
7,674,187 B2 3/2010 Cackett et al.
7,682,262 B2 3/2010 Soracco et al.
7,704,162 B2 4/2010 Rice et al.
7,708,652 B2 5/2010 Cackett et al.
7,713,140 B2 5/2010 Gibbs et al.
7,749,096 B2 7/2010 Gibbs et al.
7,749,097 B2 7/2010 Foster et al.
7,762,907 B2 7/2010 Rice
7,780,547 B2 * 8/2010 Ban ..... A63B 53/0466 473/324
7,846,038 B2 12/2010 Foster et al.
7,850,541 B2 12/2010 Meyer et al.
7,850,542 B2 12/2010 Cackett et al.
7,850,543 B2 12/2010 Rice
7,850,544 B2 12/2010 Meyer
7,892,109 B2 2/2011 Rice
7,914,394 B2 * 3/2011 Cole ..... A63B 53/047 473/332
7,931,545 B2 4/2011 Soracco
7,935,001 B2 5/2011 Meyer et al.
7,980,963 B2 7/2011 Rice et al.
8,012,041 B2 9/2011 Gibbs et al.
8,025,590 B2 9/2011 Rice et al.
8,038,544 B2 10/2011 Meyer et al.
8,047,930 B2 11/2011 Rice et al.
8,128,509 B2 3/2012 Soracco
8,257,195 B1 9/2012 Erickson
8,262,502 B2 9/2012 Rice
8,277,334 B2 10/2012 Meyer
8,328,661 B1 12/2012 Erickson
8,342,982 B2 1/2013 Clausen
8,376,876 B2 2/2013 Gibbs et al.
8,414,420 B1 4/2013 Erickson
8,425,346 B1 4/2013 Erickson
8,439,769 B2 5/2013 Rice et al.
8,449,407 B2 5/2013 Rice et al.
8,517,858 B2 8/2013 Soracco et al.
8,608,590 B2 * 12/2013 Hackel ..... A63B 53/0466 473/349
8,690,702 B2 4/2014 Abe
8,690,708 B1 4/2014 Ehlers
8,696,489 B2 4/2014 Gibbs et al.
8,696,491 B1 4/2014 Myers
8,715,107 B2 * 5/2014 Brunski ..... A63B 53/04 473/345
8,790,195 B1 7/2014 Myers et al.
8,808,107 B2 8/2014 Abe
8,826,512 B2 9/2014 Schweigert
8,834,294 B1 9/2014 Seluga et al.
8,894,506 B1 11/2014 Myers et al.
8,900,070 B1 12/2014 Dawson et al.
8,926,448 B1 1/2015 Ivanova et al.
8,956,244 B1 2/2015 Westrum et al.
8,968,116 B1 3/2015 Myers et al.
9,022,881 B1 5/2015 Ehlers
9,067,110 B1 6/2015 Seluga et al.
9,072,951 B1 7/2015 Tang et al.
9,084,921 B1 7/2015 Liang et al.
9,089,746 B2 7/2015 Schweigert
9,101,809 B2 8/2015 Gibbs et al.
9,101,811 B1 8/2015 Goudarzi et al.
9,119,999 B2 * 9/2015 Cole ..... A63B 53/0466
9,168,436 B2 10/2015 Slaughter et al.
9,180,349 B1 11/2015 Seluga et al.
9,199,145 B1 12/2015 Myers
9,211,451 B1 12/2015 Westrum et al.
9,211,453 B1 12/2015 Foster et al.
9,216,332 B1 12/2015 Ehlers et al.
9,220,957 B1 12/2015 Myers et al.
9,220,959 B2 12/2015 Roach et al.
9,259,627 B1 2/2016 Myers et al.
9,289,660 B1 3/2016 Myers
9,308,423 B1 4/2016 Tang et al.
9,333,390 B1 5/2016 Manwaring et al.
9,345,936 B1 5/2016 Westrum et al.
9,352,199 B2 5/2016 Seluga et al.
9,364,728 B1 6/2016 Myers et al.
9,364,729 B2 6/2016 Myers et al.
9,375,618 B2 6/2016 Myers et al.
9,387,376 B1 7/2016 Hall et al.
9,387,377 B2 7/2016 Liang et al.
9,409,069 B2 8/2016 Ehlers
9,463,361 B2 10/2016 Goudarzi et al.
9,486,677 B1 11/2016 Seluga et al.
9,539,476 B2 1/2017 Schweigert
9,550,097 B1 1/2017 Myers et al.
9,586,105 B1 3/2017 Westrum et al.

(56) References Cited

U.S. PATENT DOCUMENTS 9,597,558 B1 3/2017 Seluga et al.
9,597,561 B1 3/2017 Seluga et al.
9,623,294 B1 4/2017 Kingston et al.
9,623,302 B1 4/2017 Myers et al.
9,630,069 B2 4/2017 Foster et al.
9,636,553 B1 5/2017 Myers
9,669,270 B2 * 6/2017 Schweigert ..... A63B 60/00
9,675,856 B1 6/2017 Gibbs et al.
9,682,295 B1 6/2017 Dawson et al.
9,682,296 B1 6/2017 Myers et al.
9,682,298 B1 6/2017 Kingston et al.
9,682,299 B2 6/2017 Tang et al.
9,687,701 B1 6/2017 Seluga et al.
9,687,702 B1 6/2017 Seluga et al.
9,694,256 B2 7/2017 Myers et al.
9,694,257 B1 7/2017 Seluga et al.
9,694,261 B2 7/2017 Nunez et al.
9,707,459 B1 7/2017 Myers
9,713,752 B2 7/2017 Myers et al.
9,724,577 B1 8/2017 Kingston et al.
9,731,175 B1 8/2017 Myers et al.
9,731,178 B1 8/2017 Myers
9,757,629 B2 9/2017 Seluga et al.
9,776,058 B2 10/2017 Seluga et al.
9,776,060 B2 10/2017 Hall et al.
9,782,642 B1 10/2017 DeMille et al.
9,782,646 B2 10/2017 Seluga et al.
9,814,944 B1 11/2017 Greaney et al.
9,814,947 B1 11/2017 Seluga et al.
9,814,954 B2 11/2017 Westrum et al.
9,821,199 B1 11/2017 Seluga et al.
9,827,469 B1 11/2017 Seluga et al.
9,833,669 B2 12/2017 Myers et al.
9,839,818 B2 12/2017 Jertson et al.
9,839,823 B2 12/2017 Ehlers
9,849,359 B2 12/2017 Gibbs et al.
9,855,476 B2 1/2018 Seluga et al.
9,878,223 B2 1/2018 Foster et al.
9,889,349 B1 2/2018 Seluga et al.
9,889,351 B2 2/2018 Slaughter et al.
9,908,016 B2 3/2018 Seluga et al.
9,908,017 B2 3/2018 Seluga et al.
9,931,549 B1 4/2018 Seluga et al.
9,931,550 B1 4/2018 Seluga et al.
9,937,392 B2 4/2018 Myers et al.
9,956,462 B2 5/2018 Nunez
9,968,834 B1 5/2018 Seluga et al.
9,981,165 B2 5/2018 Goudarzi et al.
9,981,167 B2 5/2018 Seluga et al.
9,987,527 B1 6/2018 Myers et al.
10,004,955 B2 6/2018 Henrikson et al.
10,004,958 B2 6/2018 Tang et al.
10,010,771 B2 7/2018 Seluga et al.
10,022,601 B2 7/2018 Petersen et al.
10,022,602 B2 7/2018 Kingston et al.
10,065,085 B2 9/2018 Seluga et al.
10,065,086 B2 9/2018 Seluga et al.
10,065,091 B2 9/2018 Hall et al.
10,076,690 B2 9/2018 Myers
10,080,932 B2 9/2018 DeMille et al.
10,099,095 B2 10/2018 Myers
10,112,084 B2 10/2018 Stokke et al.
10,173,106 B2 1/2019 Slaughter et al.
10,173,110 B1 1/2019 Foster et al.
10,183,201 B2 1/2019 Schweigert
10,188,915 B1 1/2019 Hoffman et al.
10,201,733 B2 2/2019 Seluga et al.
10,213,661 B2 2/2019 Seluga et al.
10,213,662 B2 2/2019 Seluga et al.
10,213,663 B2 2/2019 Goudarzi
10,238,933 B1 3/2019 Seluga et al.
10,245,477 B2 4/2019 DeMille et al.
10,258,843 B2 4/2019 Morales et al.
10,258,846 B1 4/2019 Nunez et al.
10,265,586 B2 4/2019 Greaney
10,265,587 B2 4/2019 Willet
10,279,224 B1 5/2019 Webb et al.
10,300,355 B2 5/2019 Petersen et al.
10,335,647 B2 7/2019 Seluga et al.
10,335,650 B2 7/2019 Myers
10,363,466 B2 7/2019 Petersen et al.
10,406,407 B2 9/2019 DeMille et al.
10,406,408 B1 9/2019 Seluga et al.
10,449,423 B2 10/2019 Greaney et al.
10,463,926 B2 11/2019 Willett
10,478,683 B2 11/2019 Stokke et al.
10,486,039 B2 11/2019 Kingston et al.
10,500,449 B2 12/2019 Henrikson
10,518,141 B2 12/2019 Goudarzi et al.
10,532,258 B2 1/2020 Seluga et al.
10,543,405 B2 1/2020 Greaney
10,556,157 B2 2/2020 Greaney et al.
10,589,154 B2 3/2020 Seluga et al.
10,589,155 B2 3/2020 Hoffman et al.
10,610,748 B2 4/2020 Hoffman et al.
10,617,920 B2 4/2020 Nunez et al.
10,668,338 B2 6/2020 Morales
10,675,518 B2 6/2020 Petersen
10,688,350 B2 6/2020 Morales
10,695,621 B2 6/2020 Hoffman et al.
10,695,629 B2 6/2020 Petersen et al.
10,702,749 B2 7/2020 Webb et al.
10,722,763 B2 7/2020 Abe et al.
11,266,888 B2 * 3/2022 Kroloff ..... A63B 53/04
2001/0051548 A1 12/2001 Iwata et al.
2003/0064823 A1 * 4/2003 Yamamoto ..... A63B 53/04 473/345
2003/0181257 A1 * 9/2003 Yamamoto ..... A63B 53/04 473/345
2004/0083596 A1 * 5/2004 Willett ..... A63B 53/0466 473/331
2006/0079347 A1 * 4/2006 Gibbs ..... A63B 53/04 473/345
2007/0066420 A1 * 3/2007 Imamoto ..... A63B 53/0466 473/332
2007/0225086 A1 * 9/2007 Lin ..... A63B 60/00 473/345
2008/0096689 A1 * 4/2008 Oyama ..... A63B 53/0466 473/349
2009/0275425 A1 * 11/2009 Hirano ..... A63B 53/0466 473/345
2010/0130303 A1 * 5/2010 Stites ..... A63B 53/0466 473/349
2011/0319190 A1 * 12/2011 Wada ..... A63B 53/0466 473/349
2013/0029782 A1 * 1/2013 Goto ..... A63B 53/0466 473/345
2014/0228149 A1 * 8/2014 Cole ..... A63B 53/0466 473/332
2015/0328506 A1 11/2015 Morales et al.
2016/0114228 A1 4/2016 Jertson et al.
2016/0271461 A1 9/2016 Morales et al.
2017/0157473 A1 6/2017 Jertson et al.
2017/0319914 A1 11/2017 Jertson et al.
2018/0001160 A1 1/2018 Abe et al.
2018/0056150 A1 3/2018 Jertson et al.
2018/0178094 A1 6/2018 Morales et al.
2018/0185714 A1 7/2018 Jertson et al.
2018/0318659 A1 11/2018 Greaney et al.
2018/0318662 A1 11/2018 Greaney
2018/0318666 A1 11/2018 Morales et al.
2019/0076705 A1 3/2019 Greaney
2019/0091524 A1 3/2019 Slaughter et al.
2019/0091526 A1 3/2019 Bacon et al.
2019/0160347 A1 5/2019 Jertson et al.
2019/0192927 A1 6/2019 Bacon et al.
2019/0201752 A1 7/2019 Hoffman et al.
2019/0201753 A1 7/2019 Hoffman et al.
2019/0201754 A1 7/2019 Hoffman et al.
2019/0201756 A1 7/2019 Seluga et al.
2019/0201757 A1 7/2019 Goudarzi et al.
2019/0201759 A1 7/2019 Hoffman et al.
2019/0209904 A1 * 7/2019 Motokawa ..... A63B 53/0466

(56) References Cited

U.S. PATENT DOCUMENTS

| | | | | |
|---|---|---|---|---|
| 2019/0217167 | A1 | 7/2019 | Seluga et al. | |
| 2019/0224540 | A1 | 7/2019 | Morales et al. | |
| 2019/0232127 | A1 | 8/2019 | Petersen et al. | |
| 2019/0232129 | A1 | 8/2019 | Nunez et al. | |
| 2019/0255398 | A1 | 8/2019 | Webb et al. | |
| 2019/0262672 | A1 | 8/2019 | Seluga et al. | |
| 2019/0262675 | A1 | 8/2019 | Clarke et al. | |
| 2019/0329107 | A1 | 10/2019 | Petersen et al. | |
| 2021/0316194 | A1* | 10/2021 | Deshmukh ..... | A63B 53/0458 |

* cited by examiner

GOLF CLUB FACE PLATE HAVING CORRELATED CHARACTERISTIC TIME MEASUREMENT MAP

CROSS REFERENCE TO RELATED APPLICATIONS

This application claims the benefit of priority to U.S. Provisional App. No. 63/121,351, filed on Dec. 4, 2020, which is incorporated by reference in its entirety herein.

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates to a golf club, specifically to a golf club face plate, and, more specifically, to a golf club face plate having an internal surface design that is tied to a characteristic time (CT) measurement map and is configured to be modified to change CT measurements at various regions on the face plate. In another aspect, the disclosure is directed generally to systems for correlating CT measurements to internal face plate designs of golf clubs.

2. Description of the Background

Many golfers at all skill levels constantly seek to improve their performance and lower their golf scores. As a result, players are frequently seeking updated and improved equipment. The performance of a golf club can vary based on several factors, including face plate design. Conventional golf club face plates used in drivers and other wood-type club heads may include features for controlling a golf ball's backspin and sidespin as well as directional accuracy. Typically, external surfaces of existing face plates are designed to control these performance aspects. Two variables that can control a club head's performance include bulge and roll, which relate to the face plate's curvature. The radii values of these two variables are selected to complement the club head's estimated speed and anticipated impact moment of inertia. By selectively adjusting the radii of a face plate's bulge and roll, a golf club head may exhibit enhanced accuracy of spin and initial directional vectors, thereby resulting in farther and more accurate shots. While external surfaces of existing face plates include design variables for controlling a club head's performance, conventional internal surfaces are designed to enhance durability and strength of the face plate. Thinner face plates usually result in high velocity shots; however, face plates that are too thin may experience cracking or premature failure.

Generally, golf ball travel distance is a function of the total kinetic energy imparted to the ball during impact with the club head, neglecting environmental effects. During impact, kinetic energy is transferred from the club so that it is stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and viscoelastic relaxation of the ball, which is a material property of the polymeric materials used in all manufactured golf balls.

Viscoelastic relaxation of the ball is a parasitic energy source, which is dependent upon the rate of deformation. To decrease or minimize this effect, the rate of deformation must be reduced, which may be accomplished by allowing more club face deformation during impact. Since metallic deformation may be purely elastic, the strain energy stored in the club face is returned to the ball after impact, which may increase the ball's outbound velocity after impact. A variety of techniques may be used to vary the allowable deformation of the club face, including uniform face thinning, thinned faces with ribbed stiffeners and varying thickness, among others.

With the advent of thin walled face plates, the performance of clubs has improved considerably. By increasing the surface area of the striking face, using high strength alloys for its construction, and reducing its thickness to introduce a "trampoline" effect, golf club head designers have successfully increased the efficiency of energy transfer from a clubface to a golf ball. As a result, the United States Golf Association ("USGA") has imposed regulations to limit energy transferred from drivers to a golf ball by defining a maximum characteristic time ("CT") that the clubface may remain in contact with a suspended steel weight impacting it. The maximum CT measurement corresponds to a maximum coefficient of restitution ("COR") for clubs, which is also restricted by the USGA. Currently, the maximum COR permissible by the USGA is 0.830, and the maximum CT measurement is 257 microseconds ("μs"). CT measurement and COR, for all purposes herein, refers to CT measurement and COR as laid out, defined, and indicated as measured in the USGA's "Procedure for Measuring the Flexibility of a Golf Clubhead, Rev. 1.0.0 (May 1, 2008)". CT measurement testing is a common, and preferred, test conducted at USGA governing professional golfing events, because it is a non-destructive test that can be conducted with a club head still attached to its shaft. These measurements can be taken at any location on the face of a club. Therefore, ensuring an entirety of a face plate remains below 257 μs is essential, otherwise the club head does not conform to USGA guidelines.

As discussed above, COR and CT relate to a duration of time a clubface remains in contact with a weight. A larger CT measurement consequently indicates greater elastic deformation of the clubface, which generally results in a greater travel distance of a golf ball, and thinner golf club face plates generally exhibit greater CT measurements than thicker face plates. At the same time, CT measurements tend to vary between locations on a face plate. One proposed method of enhancing CT at specific locations of a face plate may involve removing material from an internal surface of the face plate to thin the face plate. However, the internal surface design and the corresponding face thickness of a club face plate do not necessarily correlate to the CT measurement on an external surface directly adjacent thereto. Further, modifying a thickness of a face plate at one location may adversely affect CT measurements at one or more other locations. Consequently, modifying CT measurements at targeted locations of a face plate by changing an internal surface design can be difficult. Therefore, a need exists to correlate CT measurement locations with a club face internal surface design that allows for reliable tuning of CT measurements at particular locations without degrading or adversely influencing CT measurements at adjacent locations.

SUMMARY

In some embodiments, a variable thickness face plate for a golf club head is provided. The face plate can include a longitudinal axis extending between a toe side and a heel side along a longest length of the face plate, the longitudinal axis dividing the plate into an upper region and a lower region. Further, the face plate may include a peripheral edge including an upper peripheral edge and a lower peripheral edge, the upper peripheral edge and the lower peripheral edge being separated by the longitudinal axis. The upper peripheral edge is configured to be adjacent a top, e.g., a topline or a crown, of the golf club head when the face plate is installed, and the lower peripheral edge is configured to be adjacent the sole of the golf club head when the face plate is installed. The face plate further includes a plurality of regions of constant thickness defined by an internal surface of the face plate, the thickness being measured perpendicularly from the internal surface of the face plate. The plurality of regions of constant thickness include a first subset of regions of constant thickness being disposed along a first horizontally-extending path proximate the upper peripheral edge, the first horizontally-extending path being disposed radially inward from and parallel to the upper peripheral edge, and a second subset of regions of constant thickness being disposed along a second horizontally-extending path proximate the lower peripheral edge, the second horizontally-extending path being disposed radially inward from and parallel to the lower peripheral edge.

In some embodiments, a variable thickness face plate for a golf club head is provided. The face plate can include a peripheral edge and a plurality of pads defined by an internal surface of the face plate, the plurality of pads being regions of pre-set thickness, and the thickness being measured perpendicularly from the internal surface of the face plate. A transition region exists between each of the plurality of pads on the internal surface. The internal surface of the face plate curves to adjust the thickness of the face plate within the transition region so that the pads are smoothly connected by the transition region. Further, each of the plurality of pads is defined by an enclosed boundary line comprising an upper boundary line and a lower boundary connecting two opposing side boundary lines, the enclosed boundary line defining a junction between the respective pad and the transition region surrounding the pad.

In some embodiments, a method of manufacturing a face plate for a golf club head is provided. The face plate can have a plurality of adjustable thickness regions formed on an internal surface of the face plate. The method can include selecting a quantity of adjustable thickness regions, the quantity of adjustable thickness regions corresponding to at least one of a number of adjustable thickness regions disposed along one or more horizontally-extending paths and a number of adjustable thickness regions disposed along one or more vertically-extending paths, the horizontally extending path being a parallel curve to an upper peripheral edge or a lower peripheral edge, and the vertically-extending path perpendicularly intersecting the upper peripheral edge and the lower peripheral edge. The method can further include selecting at least one horizontal spacing parameter, the horizontal spacing parameter corresponding to a spacing between each of the one or more vertically-extending paths along the upper peripheral edge, and selecting at least one thickness parameter, the thickness parameter corresponding to a thickness of the face plate at one or more of the adjustable thickness regions measured perpendicularly from the internal surface of the face plate. Furthermore, the method can include selecting at least one width parameter, the width parameter corresponding to a width of at least one of the adjustable thickness regions disposed along the one or more vertically-extending paths, the width being a distance measured between two opposing side boundary edges of the adjustable thickness region. Each of the adjustable thickness regions is defined by an enclosed boundary line comprising an upper boundary line and a lower boundary connecting the two opposing side boundary lines. The enclosed boundary line defines a junction between the respective adjustable thickness region and a transition region surrounding the adjustable thickness region, the transition region existing between each of the adjustable thickness regions. Moreover, the internal surface of the face plate curves to adjust the thickness of the face plate within the transition region so that the adjustable thickness regions are tangentially connected by the transition region.

DETAILED DESCRIPTION OF THE DRAWINGS

Figure 1:
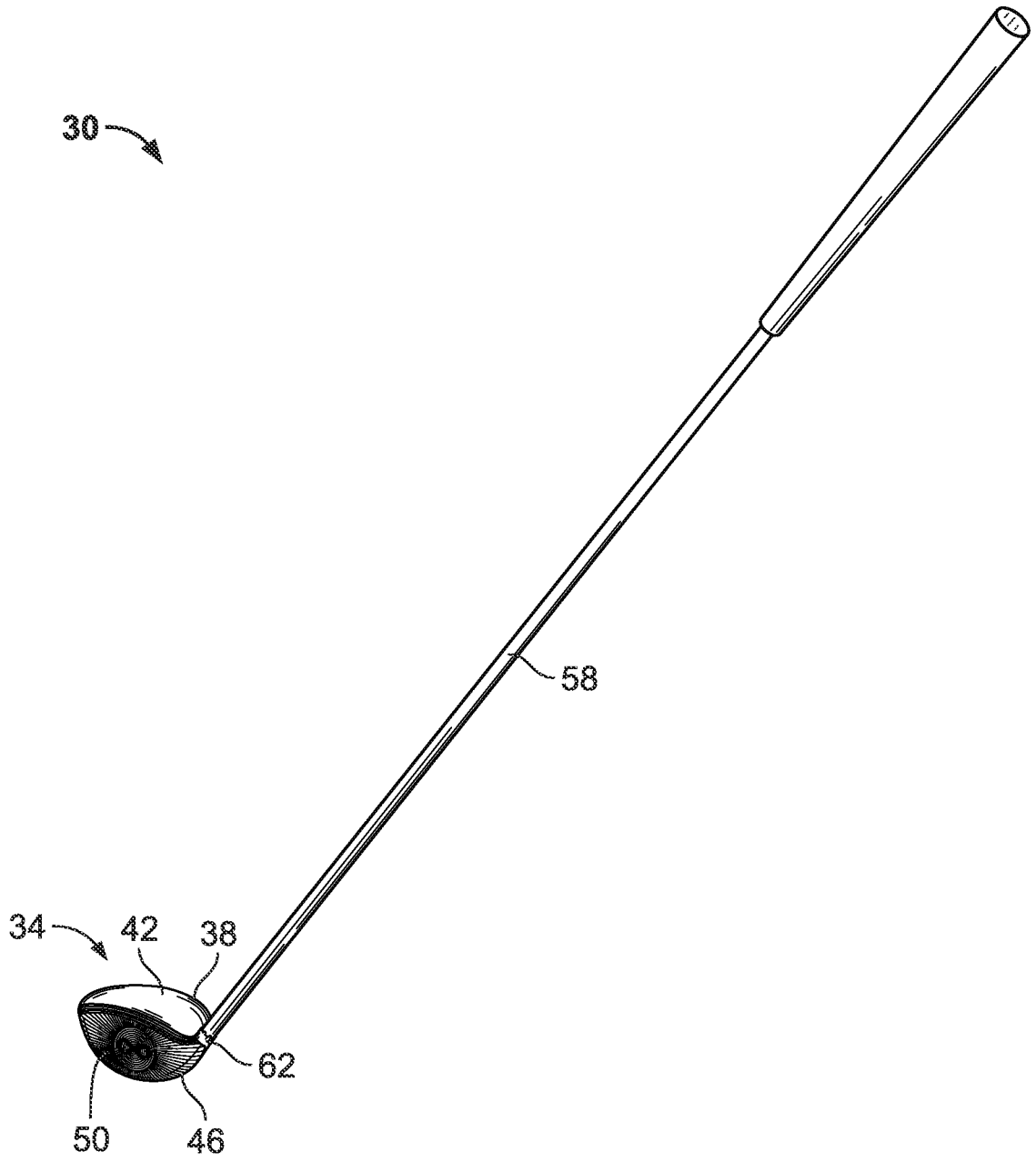
FIG. 1 is a front, top, and left isometric view of a golf club having a club head.

The following discussion and accompanying figures disclose various embodiments or configurations of a golf club head comprising a face plate with an internal surface that is correlated with a characteristic time ("CT") measurement map. The internal surface may have varying portions of constant thickness that are dimensioned to achieve particular CT measurements throughout the face plate. Varying a thickness of the face plate or other portions of the club head allows for improved performance of the club head by reducing the weight and enhancing energy transfer while maintaining acceptable durability requirements and stiffness requirements set forth by the United States Golf Association ("USGA"). As used herein, the terms "mass" and "weight" are used interchangeably, although it is understood that these terms refer to different properties in a strict physical sense.

The following discussion and accompanying figures disclose various embodiments or configurations of a golf club that includes a shaft and a golf club head. Although embodiments are disclosed with reference to a wood-type golf club, such as a driver, concepts associated with embodiments of the wood-type golf club may be applied to a wide range of golf clubs. For example, embodiments disclosed herein may be applied to a number of golf clubs including hybrid clubs, fairway wood clubs, putter-type clubs, iron-type golf clubs, utility-type golf clubs, and the like. The term "about," as used herein, refers to variation in the numerical quantity that may occur, for example, through typical measuring and manufacturing procedures used for articles of manufacture that may include embodiments of the disclosure herein. Throughout the disclosure, the terms "about" and "approximately" refer to a range of values+5% of the numeric value that the term precedes. Additionally, the term "horizontal" should be understood to refer to a general heel-to-toe direction and the term "vertical" should be understood to refer to a general crown-to-sole direction, allowing for curvature, and not being construed so as to be limited to strict linear dimensions between those respective endpoints.

Example golf club and golf club head structures in accordance with this disclosure may relate to "wood-type" golf clubs and golf club heads, e.g., clubs and club heads typically used for drivers and fairway woods, as well as for "wood-type" utility or hybrid clubs, or the like. Although these club head structures may have little or no actual "wood" material, they still may be referred to conventionally in the art as "woods," e.g., "metal woods" or "fairway woods." Alternatively, golf club and golf club head structures of the disclosure may relate to "iron-type" golf clubs and golf club heads.

The present disclosure may provide a face plate for a golf club head that incorporates a customized CT measurement map with a correlated internal face design. The CT measurement map may be established using historical CT data from existing face plates, failure testing, fabrication processes, predicted and/or preferred ball contact locations and speeds, and additional computer algorithms to link CT measurements to geometrical characteristics of an internal surface of a golf club face plate. Consequently, CT measurements at various, targeted locations on a golf club face plate can be modified in a correlated manner, which may mitigate adverse CT measurement impacts at other locations on the golf club face plate during face plate design. More specifically, the face plate may include a plurality of discrete regions of constant thickness that can be dimensioned to achieve or adjust one or more of the CT measurement points. For example, one or more of the regions, which may also be referred to as "pads" herein, are internal surface offsets from the external surface and, accordingly, are regions of constant thickness. In this regard, it should be understood that "constant thickness" refers to a thickness of each pad, individually, and that variations in thickness as among different pads may still exist. Each of these pads may be associated with the CT measurement map so that adjustments to the dimensions of one or more pads can adjust CT measurements at one or more regions of the face plate in a predictable manner. That is, changing the thickness or size of one or more of the pads may change CT measurements at one or more regions on the face plate.

In some instances, the CT measurement map may be integrated into a computer aided design ("CAD") program so that a user may select and modify one or more parameters associated with dimensions of the pads on an internal surface of a golf club face plate. Each of these pads may be controlled by one or more dimensional variables, such as, e.g., width, height, and thickness from an external surface of the face plate. In response to selecting one or more parameters, the CT measurement map may update accordingly to display estimated CT values at various locations on the external surface of the face plate. For example, CT measurements may be numerically displayed with a three-dimensional CAD model of the face plate. Additionally or alternatively, the CT measurements may be displayed in a chart or table.

The system may also be configured so that a user may select or pre-set one or more CT measurements at one or more regions on the external surface of the face plate, and dimensions or other parameters associated with one or more pads on the internal surface of the face place may be provided or calculated to achieve the selected CT measurements. For example, algorithms may be used to determine necessary parameters to achieve the desired CT measurement while mitigating adverse impacts to different areas of the face plate. Therefore, aspects of the present disclosure may enable enhanced CT measurements and, accordingly, performance of the face plate to be achieved by analytically determining dimensions and designs of the pads formed on the internal surface of the golf club face plate. Moreover, in any instance, the face plate design with the correlated CT measurement map may be analyzed using finite element analysis ("FEA"). For example, FEA may be used to ensure the structural integrity of the face plate remains intact before fabrication thereof. Incremental changes may be made to the face plate design and subsequent finite element analyses may be conducted before a face plate design is finalized, prototyped, and/or fabricated.

Face plates according to aspects of the present disclosure may incorporate a plurality of pads, or regions of constant thickness, that are thicker than a nominal thickness of the face plate, the latter which may be measured at a periphery of the face plate. Throughout the specification herein, the pads and surrounding surfaces may be described having a "tangential" relationship to one another. Correspondingly, the pads may be described as being "tangentially connected."

Furthermore, throughout the specification, relationships are provided between the periphery of the face plate and the internal surface design of the face plate. Particularly, the shapes and positioning of the pads defined by the internal surface may be functions of the periphery curvature. The periphery or peripheral edge, as used herein, correspond to a perimeter or external boundary of the plate. The periphery or perimeter of face plates according to aspects of the present disclosure is generally a curved boundary comprising varying degrees of curvature. Aspects of the pads on the internal surface, e.g., the boundaries and positioning of the pads, may be functions of the curvature of the periphery. More specifically, as will be described in greater detail below, one or more edges of the pads may be disposed along paths that are parallel offsets or offset curves of the periphery of the face plate. As used herein, "parallel offsets" and "offset curves" are used to describe lines that are equally spaced along lengths thereof. For example, as used herein, a line or path may be a parallel offset to the peripheral edge of the face plate if it is substantially equally spaced from the periphery along its length, the spacing being measure normally, or perpendicularly, to the lines. In some instances, lines having this relationship may be described as "parallel curves". Furthermore, one or more other edges of the pads may be disposed along paths that are normal to the periphery of the face plate. As used herein, for example, a line or path may be normal to the peripheral edge if it intersects the peripheral edge perpendicularly, or at a right angle. In some instances, the pads may be disposed along a path that curves to intersect the periphery normally at two points.

Figure 2:
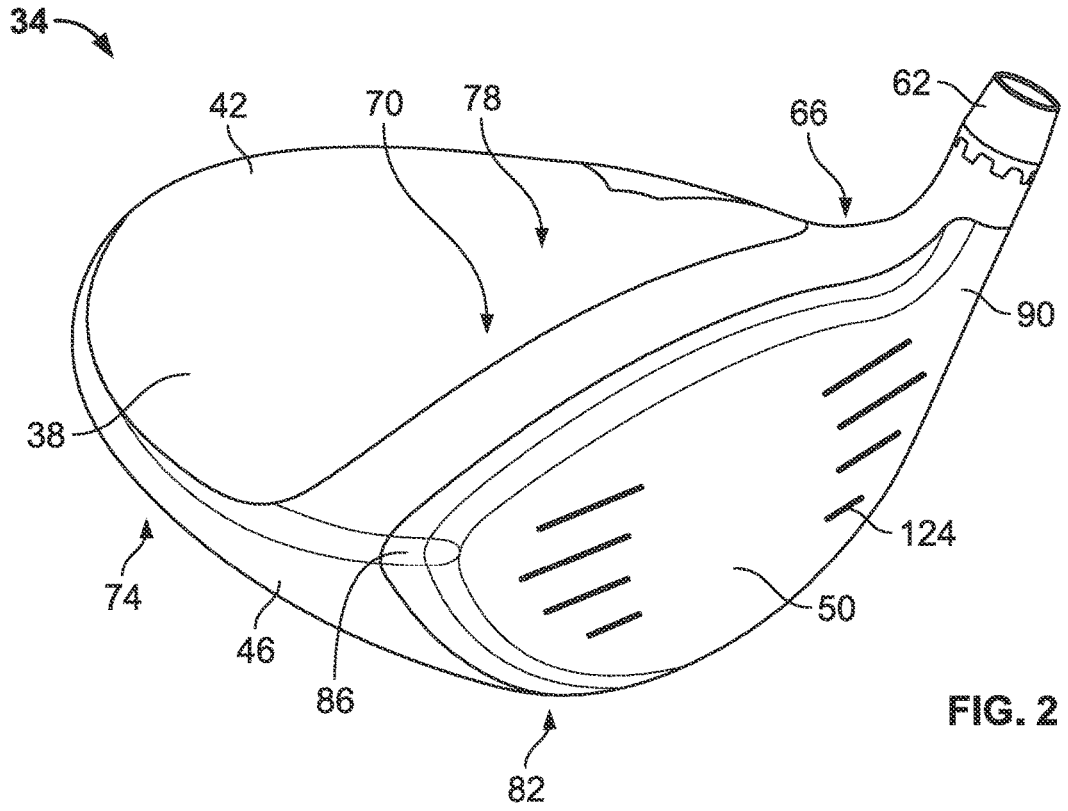
FIG. 2 is a front, top, and right isometric view of the club head of FIG. 1 including a face plate in accordance with aspects of the present disclosure.

Referring now to FIG. 1, a golf club 30 is illustrated, the golf club 30 being shown at address and comprising a golf club head 34 that includes a body 38 having a crown 42, a sole 46, and a face plate 50 according to aspects of the present disclosure, the body 38 defining an interior cavity. A golf club shaft 58 extends from a hosel 62 that extends from the body 38 of the club head 34. Referring to FIG. 2, an isometric view of the golf club head 34 of FIG. 1 is shown, which highlights the crown 42, the face plate 50, the sole 46, and varying regions of the club head 34. The hosel 62 is disposed within a heel region 66. A medial region 70 is disposed adjacent the heel region 66, the medial region 70 being disposed between the heel region 66 and a toe region 74. The toe region 74 is shown opposite the heel region 66.

Figure 3:
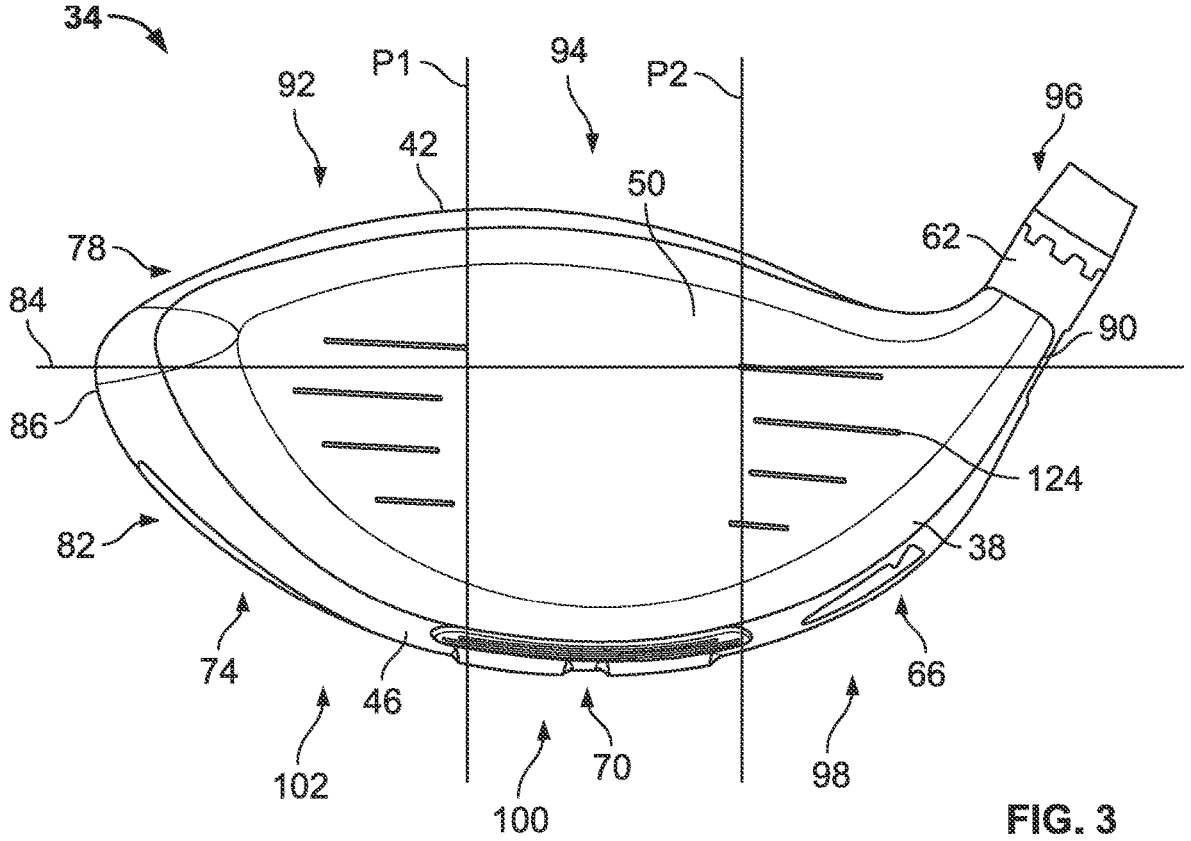
FIG. 3 is a front elevational view of the club head of FIG. 2.

FIG. 3 illustrates a front view of the golf club head 34, particularly highlighting the face plate 50 and varying regions of the club head 34 that are illustrated with a coordinate system overlaid thereon. The heel region 66, the medial region 70, and the toe region 74 may be defined by lines P1 and P2, which extend over the face plate 50 of the club head 34. The club head 34 may further define a crown region 78 and a sole region 82, which may also be referred to herein as an upper region and a lower region, respectively. The crown region 78 and the sole region 82 may be defined by a longitudinal axis 84 that extends between a distal toe end 86 of the toe region 74 and a distal heel end 90 of the heel region 66 so that it extends along a longest length of the face plate 50. The longitudinal axis 84 may define a horizontal direction that runs parallel to the longitudinal axis 84. Correspondingly, a vertical direction is defined perpendicular to the longitudinal axis 84.

The lines P1, P2 and the longitudinal axis 84 define a grid that comprises two rows and three columns, i.e., an m×n grid where m and n are 3 and 2, respectively. The grid defines six sub-regions 92, 94, 96, 98, 100, 102, each of which is disposed in one of the heel region 66, the toe region 74, or the medial region 70 and one of the crown region 78 or the sole region 82. While all of the sub-regions are not specifically referenced herein, each location along the face plate 50 defines a coordinate that can be considered to be disposed within a sub-region defined by two of the regions 66, 70, 74, 78, 82. For example, the hosel 62 is located within the heel region 66 and the crown region 78, and may be referred to as being disposed within the upper, heel sub-region 94 of the face plate 50. Further, for example, the sub-region 102 is disposed within the toe region 74 and the sole region 82. Therefore, it should be noted that the various sub-regions are defined by the intersections of the regions 66, 70, 74, 78, 82 disclosed herein. The following disclosure may describe varying configurations or positions of regions of constant thickness, also referred to as pads, with reference to the grid overlaid upon the face plate 50 of the club head 34 depicted in FIG. 3.

Figure 4:
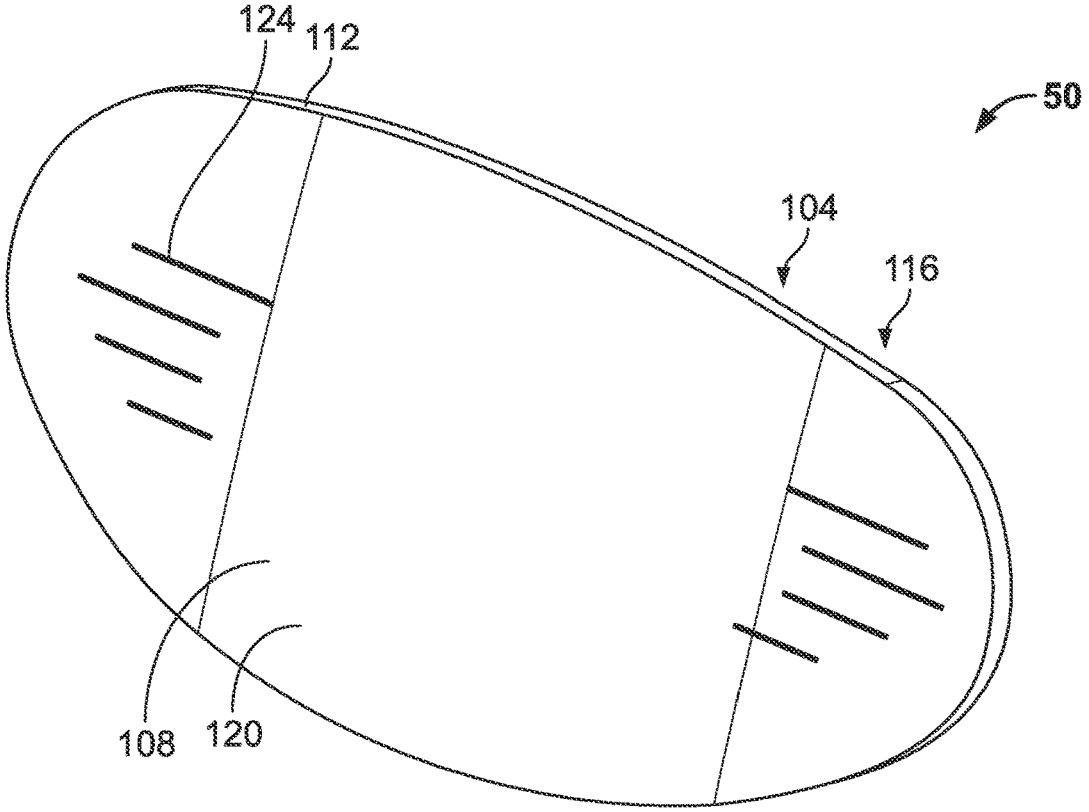
FIG. 4 is a front, top, and left isometric view of the face plate of FIG. 2.
Figure 5:
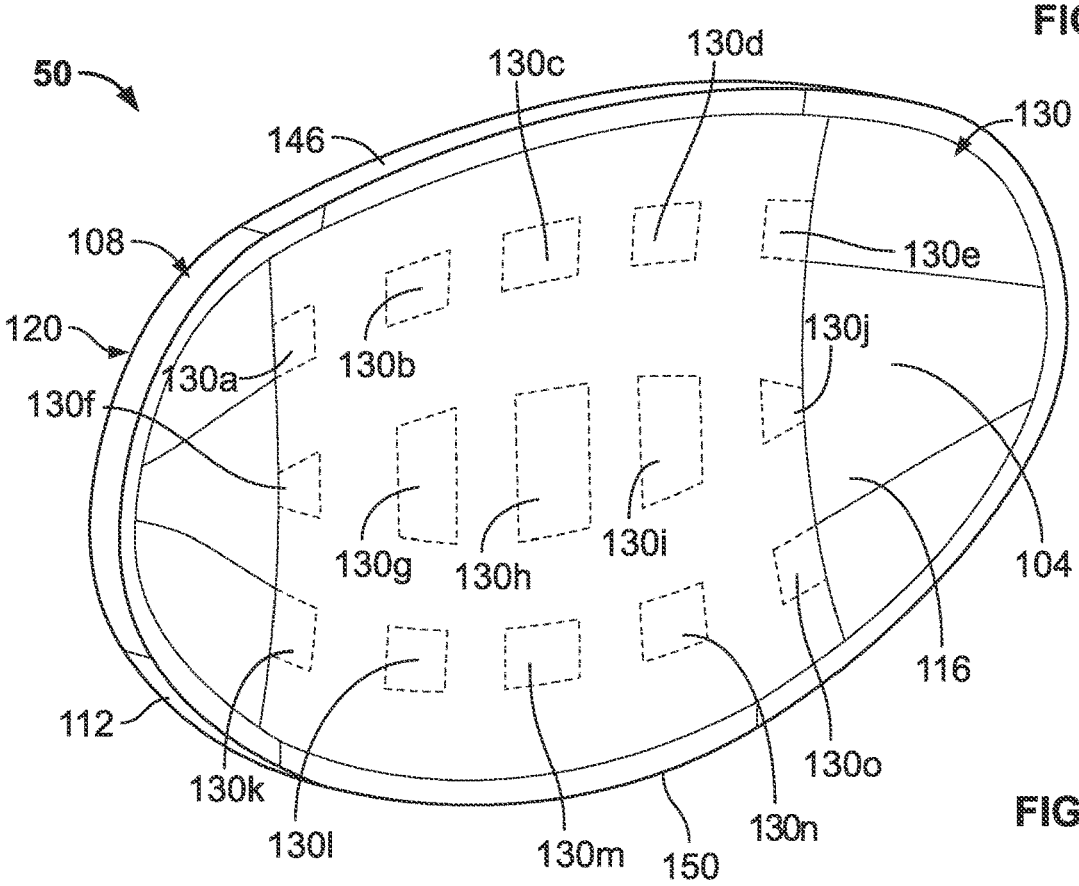
FIG. 5 is a rear, top, and left isometric view of the face plate of FIG. 4.

As discussed above, the present disclosure may provide a face plate and systems and methods of adjusting CT measurements at discrete locations or regions on the face plate by modifying a variety of dimensional parameters associated with an internal surface design of the face plate. For example, FIGS. 4 and 5 illustrate the face plate 50 according to an embodiment of the present disclosure configured for use in a golf club head, such as the golf club head 34 of FIG. 1-3. The face plate 50 may generally define a substantially plate-like article comprising a first side 104 (see FIG. 5), an opposing second side 108 (see FIG. 4), and an outer peripheral edge 112. In the illustrated embodiment, and referring particularly to FIG. 5, the first side 104 defines an internal surface 116 and is generally configured to project toward an interior cavity of a golf club head when installed therein. Accordingly, the opposing second side 108 (see FIG. 4) defines an external surface 120, which is configured to be visible from an exterior of the golf club head. In some embodiments, as shown in FIG. 4, the external surface 120 may include one or more aerodynamic features 124, such as those disclosed within U.S. Pat. No. 10,780,328, which is incorporated by reference herein in its entirety. The face plate 50 or portions of the body 38 may define any number of aerodynamic features, and the aerodynamic feature 124 is included for exemplary purposes only.

Figure 6:
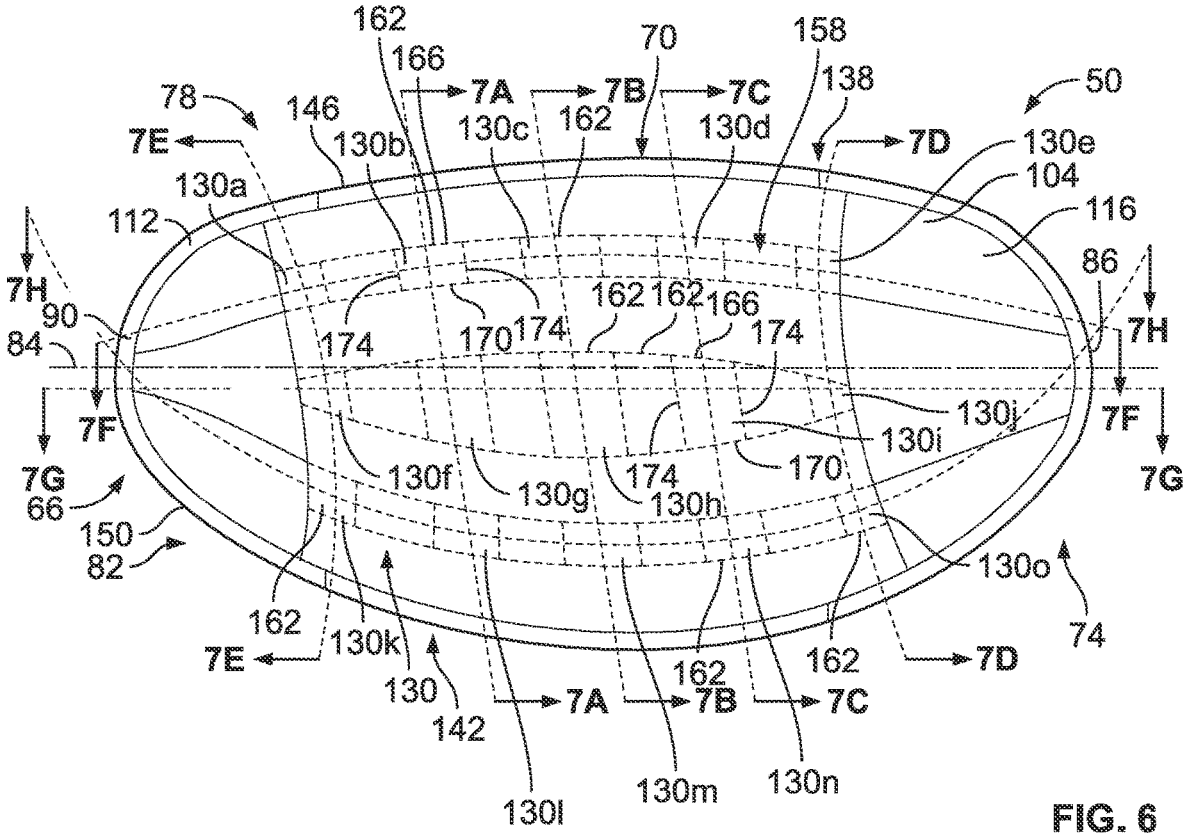
FIG. 6 is a rear elevational view of the face plate of FIG. 4.
Figure 7A:
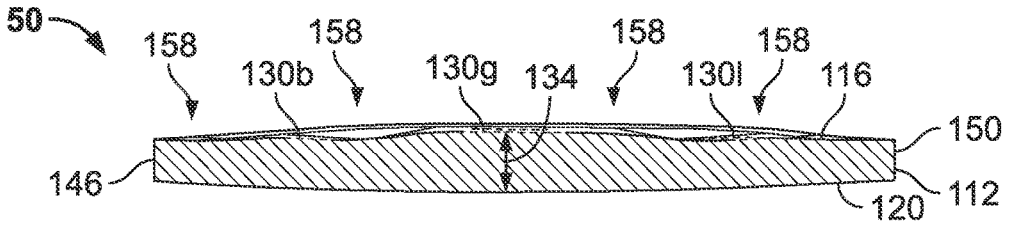
FIG. 7A is a cross-sectional view taken through line 7A-7A of FIG. 6.
Figure 7B:
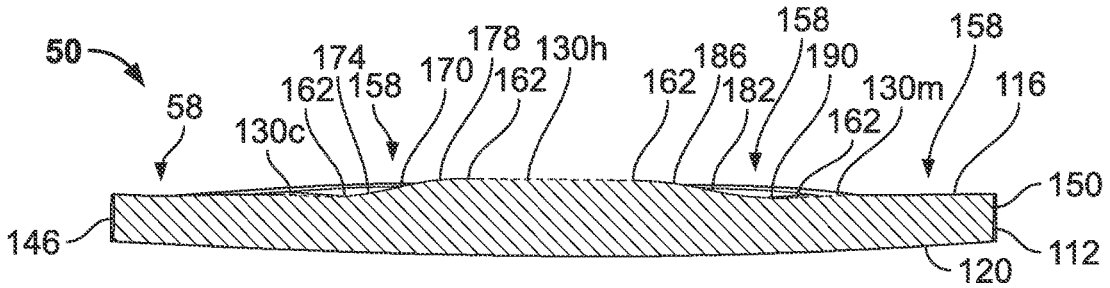
FIG. 7B is a cross-sectional view taken through line 7B-7B of FIG. 6.
Figure 7C:
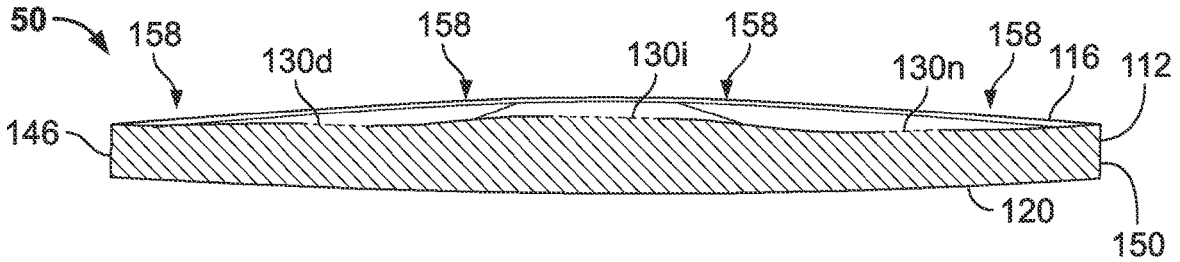
FIG. 7C is a cross-sectional view taken through line 7C-7C of FIG. 6.
Figure 7D:
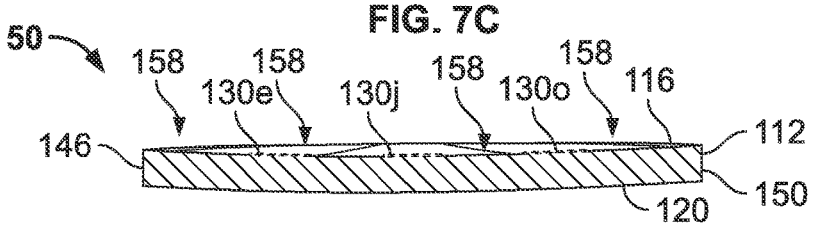
FIG. 7D is a cross-sectional view taken through line 7D-7D of FIG. 6.
Figure 7E:
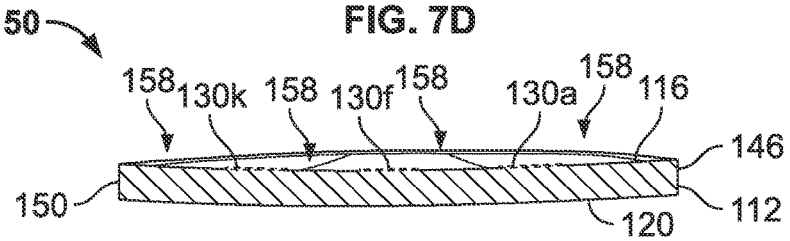
FIG. 7E is a cross-sectional view taken through line 7E-7E of FIG. 6.

FIG. 6 is a schematic view of the face plate 50. The internal surface 116 of the face plate 50 includes a plurality of pads 130, which are generally regions of constant thickness. These pads 130 may also be referred to as regions of variable thickness (as compared to other pads), regions of increased thickness (as compared to a nominal thickness of the face plate or a thickness of the peripheral edge), or regions of adjustable thickness (as compared to either other pads or the nominal thickness of the face plate). In the embodiment illustrated, for purposes of description only, the pads 130 are sequentially labeled with a letter, e.g., pads 130*a*-pads 130*o*, although it should be understood that the face plate 50 may include more or fewer pads than those shown in FIG. 6. Generally, these pads 130 are portions of the face plate 50 having defined and/or constant thicknesses. Turning to FIG. 7A, for purposes of description herein, "thickness" may generally be a measurement taken perpendicularly between the internal surface 116 and the external surface 120. Each pad 130 defined by the internal surface 116 may be offsets of the external surface 120 and, thus, they may exhibit the same curvature as its corresponding region of the external surface 120. Therefore, the thickness is measured between the internal surface 116 and the external surface 120 along a path that is substantially normal to the surfaces 116, 120, an example of which is shown by line 134 in FIG. 7A.

Face plates according to embodiments of the present disclosure may be fabricated by way of a variety of methods of manufacture. For example, metal stamping may be used to form a plurality of pads on a surface of material before being trimmed to form a periphery of a face plate. Particularly, with reference to the face plate 50 of FIG. 6, a blank of metal, e.g., a ⅛" or ¼" plate, may be stamped to form the plurality of pads 130 and trimmed to form the outer peripheral edge 112 of the face plate 50. The face plate 50 may subsequently be incorporated into a golf club head, e.g., the golf club head 34 of FIG. 2 by welding the face plate 50 to portions of a remainder of the body 38, i.e., portions of the crown 42 and the sole 46. Alternatively, in some embodiments, a plate of metal may be trimmed prior to being stamped. Additional and alternative fabrication methods may include milling and/or casting.

Referring to FIGS. 5 and 6, according to some embodiments, the pads 130 may be distributed across the face in a q×r grid-like pattern. Particularly, in the embodiment illustrated, fifteen pads 130 are distributed so that they define a 5×3 grid pattern. Again, for purposes of description, each of the plurality of pads 130 is labeled alphanumerically from 130*a* to 130*o*. Alternative embodiments may include more or fewer pads disposed in a variety of patterns. For example, face plates according to alternative embodiments may include 12 pads distributed in a 4×3 pattern, 8 pads arranged in a 4×2 pattern, or 20 pads arranged in a 5×4 pattern. While there are benefits to distributing the pads in a substantially symmetrical pattern like the pads 130 shown in FIG. 6, symmetry is not necessary. Furthermore, while the pads 130 are distributed over a majority of the internal surface 116, e.g., over more than 50% of the internal surface 116, the pads may occupy less than 50% of the internal surface in alternative embodiments. Consequently, the disclosure is not limited to the number and configuration of pads illustrated herein.

Referring particularly to FIG. 6, the longitudinal axis 84 divides the face plate 50 into an upper region 138 and a lower region 142, the upper region 138 configured to be disposed proximate a crown of a golf club head, and the lower region 142 configured to be disposed proximate a sole of a golf club head when the face plate 50 is installed therein. Accordingly, the upper region 138 generally occupies the crown region 78, and the lower region 142 occupies the sole region 82. Correspondingly, the longitudinal axis 84 may divide the peripheral edge 112 into an upper peripheral edge 146 and a lower peripheral edge 150 that are associated with the upper region 138 and the lower region 142, respectively. The upper peripheral edge 146 thus may be configured to contact or couple to a golf club head at, proximate, or adjacent the crown 42 (see FIG. 2), whereas the lower peripheral edge 150 is configured to contact or couple to a golf club head at, proximate, or adjacent the sole 46 (see FIG. 2) thereof. The peripheral edge 112 comprising the upper peripheral edge 146 and the lower peripheral edge 150 is a curved edge that may be substantially free of discontinuities. That is, the peripheral edge 112 is a smooth, curved edge that circumscribes an entirety of the face plate 50 and is substantially free of sharp corners or abrupt changes in direction. The curvature of the peripheral edge 112 may influence and/or be used to determine a curvature and positioning of the pads, which will be described in greater detail herein.

Still referring to FIG. 6, the plurality of pads 130 are distributed along the internal surface 116 of the face plate 50 having a transition region 158 disposed between each of the pads 130. Each of the pads 130 may be defined by an enclosed boundary 162, which is shown using dashed reference lines in FIG. 6. The boundary 162 may comprise multiple linear or curvilinear boundary line segments connected together. In the embodiment illustrated, each boundary 162 includes an upper boundary line segment 166 and a lower boundary line segment 170 connected by opposing lateral boundary line segments 174, which may also be referred to as side boundary line segments. For the purpose of clarity, the figures only include labels for select pads 130 and their boundary line segments 166, 170, 174; however, it should be understood that each pad 130 includes a boundary 162 having an upper boundary line segment 166, a lower boundary line segment 170, and opposing lateral boundary line segments 174, as shown in connection with the pad 130*b* and the pad 130*i* of FIG. 6. The boundary 162 of each pad 130 represents a junction between the pad 130 and the surrounding transition region 158. Thus, the boundary line segments 166, 170, 174 may define the locations at which the internal surface 116 of the face plate 50 transitions between one of the pads 130 and the surrounding transition region 158.

In some embodiments, the internal surface 116 of the face plate 50 tangentially transitions between the pads 130 and the transition region 158 at each of the boundary line segments 166, 170, 174, thereby defining a transitional surface that may be free of sharp edges at the edges of each pad. In this context, for example, referring to FIG. 7A, which illustrates a cross-sectional view of the face plate 50 taken along line 7A-7A of FIG. 6, the internal surface 116 is designed so that it is free of discontinuities in the form of openings, holes, steps, etc. For example, the internal surface 116 tangentially transitions between the transition region 158 and each of the pads 130, thereby defining a smooth, curved surface. These tangential transitions may change a height of each pad around its periphery slightly by creating a radiused edge instead of a right angle, but the pads still may be considered to have a constant thickness. In the transition region 158, the internal surface 116 of the face plate 50 tangentially extends away from one of the pads 130, curves toward another one of the pads 130 to increase or decrease a thickness of the face plate 50, and tangentially or smoothly transitions into an adjacent one of the pads 130. Furthermore, the thickness of the face plate 50 between two adjacent pads 130 may be between the thicknesses of the adjacent pads 130. For example, if two adjacent pads 130 have respective thicknesses of about 2.5 mm and about 3.1 mm, the thickness of the face plate 50 directly between the two adjacent pads 130 would have maximum and minimum values of about 3.1 mm and about 2.5 mm, respectively. Depending on the location of the pad 130, rather than extending into another one of the pads 130, the internal surface 116 may tangentially extend into the peripheral edge 112 of the face plate 50. In this instance, the thickness of the face plate 50 between the pad 130 and the peripheral edge 112 may be between the thickness of the pad 130 and the thickness of the peripheral edge 112. For example, if the thickness of the pad 130 is about 2.7 mm, and the thickness of the peripheral edge 112 is about 2.2 mm, the face plate may have a thickness between about 2.2 mm and 2.7 mm between the pad 130 and the peripheral edge 112. Therefore, within the transition region 158, the internal surface 116 of the face plate 50 curves to gradually adjust the thickness of the face plate 50.

FIG. 7B-7H illustrate additional cross-sectional views of the face plate 50 taken at various locations. At some locations, adjacent pads 130 may have significant changes in thickness. For example, the pads 130*c*, 130*h*, 130*m* shown in FIG. 7B exhibit very different thicknesses. Thus, the internal surface 116 curves within the transition region 158 to tangentially transition into and out of each of the pads 130*c*, 130*h*, 130*m*. Accordingly, in one aspect, the internal surface 116 may extend from the pad 130*c*, curve upwardly, i.e., away from the external surface 120 to a first inflection point 170, thereby defining a concave curve 174 from the boundary 162 of the pad 130*c* to the first inflection point 170. In another aspect, the internal surface 116 may extend downwardly from the pad 130*c* to a thickness between that of the pad and a nominal thickness of the face plate, before curving upwardly at a nadir to the first inflection point 170. As used herein, an "inflection point" is generally a point at which a curve transitions from a concave curve to a convex curve or vice versa. The internal surface 116 may subsequently curve from the first inflection point 170 to the pad 130*h* so that it tangentially meets the pad 130*h* at the boundary 162 thereof, thereby defining a convex curve 178. Within the boundary 162 of the pad 130*h*, the internal surface 116 is substantially parallel to the external surface 120. Accordingly, within the boundary 162 of the pad 130*h*, the face plate 50 has a substantially constant thickness. Further, the internal surface 116 may exhibit the similar curves within the transition region 158 between the pad 130*h* and the pad 130*m*. For example, the internal surface 116 may tangentially extend from the pad 130*h* before curving downwardly, i.e., toward the external surface 120, to a second inflection point 182, thereby defining a convex curve 186. From there, the internal surface 116 may smoothly transition into a concave curve 190 and, subsequently, the pad 130*m*. In still another aspect, the internal surface 116 may define a concave curve entirely or substantially entirely between adjacent pads, although a degree of concavity may vary, such that the surface is more concave proximate a first pad and less concave proximate the other pad.

Similarly to the pad 130*h*, within the boundaries of the pad 130*c* and the pad 130*m*, the internal surface 116 is substantially parallel to a corresponding region of the external surface 120. The corresponding region of the external surface 120 is generally the region on the external surface 120 immediately or proximately opposing the portion of the internal surface 116 defined by the pad. Differently said, the corresponding region of the external surface 120 may be a region within a boundary that is generally a projection of the boundary 162 on the internal surface 116. This relationship may be true for each of the pads 130*a*-130*o*. Furthermore, the transition region 158 as described above may be applicable to each transition region 158 throughout an entirety of the internal surface 116. That is, internal surface 116 may smoothly transition between each of the pads 130*a*-130*o* so that it defines a series of curves as described above.

At some locations on the internal face plate 50, differences between thicknesses of the pads 130 may be less substantial. For example, referring to FIG. 7D, pads 130*e*, 130*j*, 130*o* are shown. In the illustrated embodiment, each of the pads 130*e*, 130*j*, 130*o* may include similar thicknesses with respect to one another, as well as smaller deviations versus a nominal thickness of the face plate as compared to other pads disposed on the plate. Therefore, within the transition region 158 of the portion of the face shown in this figure, the internal surface 116 makes marginal changes to the thickness of the face plate 50.

Figure 7F:
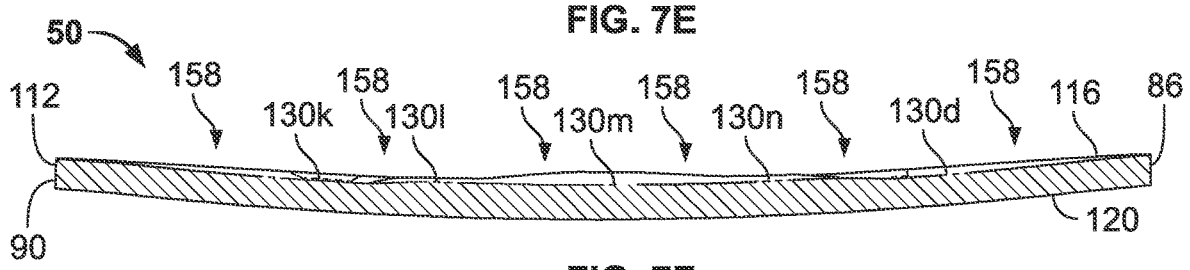
FIG. 7F is a cross-sectional view taken through line 7F-7F of FIG. 6.
Figure 7G:
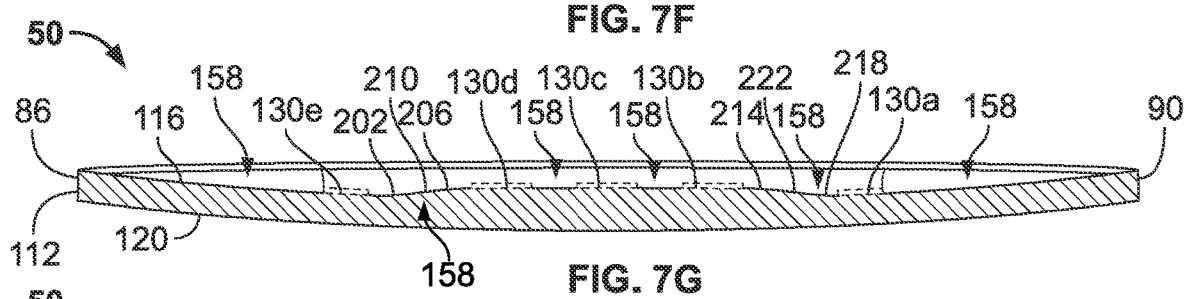
FIG. 7G is a cross-sectional view taken through line 7G-7G of FIG. 6.
Figure 7H:
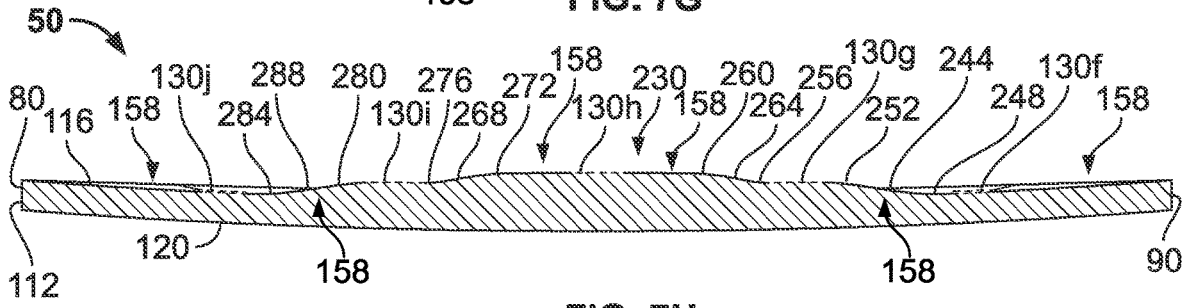
FIG. 7H is a cross-sectional view taken through line 7H-7H of FIG. 6.

Each of the cross-sections shown in FIG. 7A-7E are taken in the vertical direction. FIG. 7F-7H illustrate cross-sections of the face plate 50 along the horizontal direction. As seen in FIG. 7F, in some instances, changes in face plate thickness along the horizontal direction may be comparatively minor. More specifically, each of pads 130*k*, 130*l*, 130*m*, 130*n*, 130*o* have similar face plate thicknesses, so the internal surface 116 may not curve considerably to change the thickness of the face plate 50 within the transition region 158 between the pads 130*k*, 130*l*, 130*m*, 130*n*, 130*o*. At some areas, however, the thickness of the face plate 50 varies more significantly between one or more pairs of pads 130. For example, referring to FIG. 7G, the pads 130*e*, 130*a* may be disposed on opposing sides of pads 130*d*, 130*c*, 130*b*, and may have a smaller thickness than the pads 130*d*, 130*c*, 130*b*. Therefore, the internal surface 116 may extend tangentially from the pad 130*e* to the pad 130*d* so that it forms a concave curve 202 and a convex curve 206 separated by an inflection point 210, changing the face plate thickness while tangentially or smoothly extending into the pad 130*d*. Moreover, the internal surface 116 may tangentially extend from the pad 130*b* to the pad 130*a* such that it forms a convex curve 214 and a concave curve 218 divided by an inflection point 222.

In some regions, the thickness of the face plate 50 may gradually increase from the peripheral edge 112 to a central region 230 of the face plate 50. For example, referring now to FIG. 7H, the face plate 50 may have pads 130*j*, 130*i*, 130*h*, 130*g*, 130*f* disposed generally horizontally across the internal surface 116 thereof. In the illustrated embodiment, the internal surface 116 may extend from the peripheral edge 112 to the pad 130*f* such that it gradually changes the thickness of the face plate 50 before tangentially extending into the pad 130*f*. From the pad 130*f*, the internal surface 116 may smoothly extend therefrom before concavely curving and extending to an inflection point 244, thereby defining a concave curve 248. The internal surface 116 may subsequently extend from the inflection point 244 to the pad 130*g*, convexly curving to define a convex curve 252 before tangentially extending into the pad 130*g*. Thus, the internal surface 116 increases the thickness of the face plate 50 from the pad 130*f* to the pad 130*g*, and thickness of the face plate 50 in the transition region 158 between the pad 130*f* and the pad 130*g* is between the thicknesses of the pads 130*f*, 130*g*. (As noted above, in another aspect, a minimum thickness of the transition region 158 may be less than a minimum thickness of the pads 130*f*, 130*g*.) Similarly, from the pad 130*g*, the internal surface 116 may define a concave curve 256 and a convex curve 260 connected by an inflection point 264 before tangentially extending into the pad 130*h* so that the thickness of the face plate 50 further increases from the pad 130*g* to the pad 130*h*. The internal surface 116 extends in a substantially symmetrical manner between the pads 130*h*, 130*i*, 130*j*. For example, from the pad 130*h*, the internal surface 116 may tangentially extend therefrom before extending and curving to an inflection point 268 to form a convex curve 272. From the inflection point, the internal surface 116 may extend and curve to define a concave curve 276 before tangentially extending into the pad 130*i*. Therefore, the internal surface 116 curves to decrease the thickness of the face plate 50 from the pad 130*h* to the pad 130*i*. Similarly, the internal surface 116 may tangentially extend from the pad 130*i* to define a convex curve 280 and a concave curve 284 connected at an inflection point 288 before tangentially extending to the pad 130*j*, thereby decreasing the thickness of the face plate 50. Furthermore, the internal surface may tangentially and gradually extend from the pad 130*j* to the peripheral edge 112. As a result, the internal surface 116 gradually curves so that the thickness of the face plate 50 gradually increases from the peripheral edge 112 to the central region 230 of the face plate 50.

As discussed above, the face plate 50 includes a plurality of pads 130 having varying thicknesses. For example, one or more of the pads 130 may have a thickness between about 2.0 mm and about 3.5 mm. In some embodiments, one or more of the pads 130 may have a thickness between about 2.1 mm and about 2.4 mm or between about 3.0 mm and about 3.3 mm. In some embodiments, the thickness of each of the plurality of pads 130 may be at least about 1.8 mm, about 2.4 mm, or about 3.2 mm. In some embodiments, the thickness of each of the plurality of pads 130 may be less than about 3.6 mm, about 2.7 mm, or about 2.3 mm. In this regard, "varying thickness" may be understood to mean that a thickness of a given pad may be generally uniform but that that thickness may be different from that of another one or more of the pads.

The thickness of the face plate 50 may be substantially uniform along the peripheral edge 112. In some embodiments, the thickness of the peripheral edge 112 may be between about 1.0 mm and about 2.2 mm. The thickness of the peripheral edge 112 may be, in some embodiments, between about 1.5 mm and about 2.0 mm. In some embodiments, the thickness of the peripheral edge 112 may be at least about 0.8 mm and/or less than about 1.8 mm. Further, in some embodiments, the thickness of the peripheral edge 112 may be less than the thickness of each of the plurality of pads 130. However, in some embodiments, the thickness of the face plate 50 along the peripheral edge 112 may not be substantially uniform.

The thickness of the pads 130 and/or the peripheral edge 112 may be determined by way of a variety of methods. For example, one or more of the thicknesses may be determined via trial and error. That is, in response to results from testing and/or analyses, such as FEA, one or more of the thicknesses may be selectively increased or decreased to influence stress distribution about the face plate. Similarly, in response to tests that determine projected or actual characteristic time measurements across a face plate, one or more of the thicknesses may be adjusted to modify the characteristic time measurements. Therefore, the thicknesses may be iteratively adjusted to achieve an enhanced face plate design. Additionally or alternatively, these thicknesses may be determined using equations or algorithms that are configured to determine design parameters required to achieve specific results. More specifically, if a thickness of one pad is selected or adjusted by a user, algorithms may be use to adjust one or more of the remaining thicknesses to enhance the face plate design and to minimize negative changes to characteristic time measurements and/or stress distributions across the face plate. Moreover, the design of the transition region, e.g., the radii of curvature and associated thicknesses, may be determined using equations or algorithms as well. For example, when (or as) the thickness across a face plate are adjusted, either by a user or via computer aided design analyses, the curvatures within the transition region may be passively adjusted to achieve particular design characteristics and/or establish an enhanced face plate design.

Figure 8:
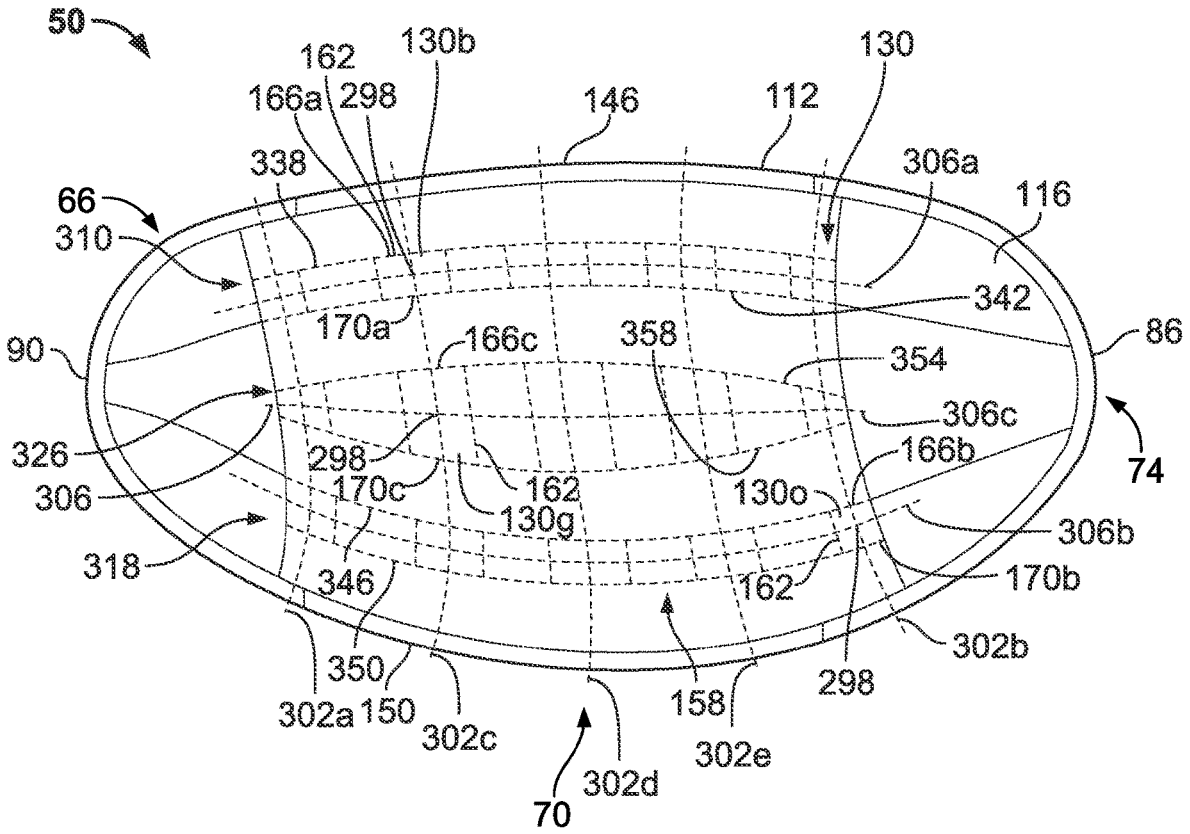
FIG. 8 is another rear elevational view of the face plate of FIG. 6.

Referring to FIG. 8, as discussed above, the plurality of pads 130 may be arranged in a grid-like pattern. For example, in the illustrated embodiment, the pads 130 are arranged along a plurality of generally vertically-extending and generally horizontally-extending paths. More specifically, each pad 130 includes a center point 298 that is substantially centrally disposed relative to the respective boundary 162, and the pads 130 are arranged so that a plurality of pads have their center points 298 disposed along at least one generally vertically-extending path and at least one generally horizontally-extending path. A first generally horizontal subset 310 of pads 130, particularly, is disposed along a first generally horizontally-extending path 306*a* that is disposed proximate the upper peripheral edge 146. The first generally horizontally-extending path 306*a* is disposed inwardly from the upper peripheral edge 146. Further, the first generally horizontally-extending path 306*a* may be substantially parallel to the upper peripheral edge 146. That is, the locations of the pad centers 298 of the first generally horizontally-extending path 306*a* may be a function of the upper peripheral edge 146 so that it is an offset curve of the upper peripheral edge 146. Thus, the center points 298 of each of the pads 130 of the first generally horizontal subset 310 may be substantially equidistant from the upper peripheral edge 146. Similarly, a second generally horizontal subset 318 of pads 130 may have their centers 298 be disposed along a second generally horizontally-extending path 306*b* that is disposed proximate the lower peripheral edge 150 and is disposed radially inwardly from the lower peripheral edge 150. The second generally horizontally-extending path 306*b* may similarly be an offset curve of the lower peripheral edge 150. Therefore, the first generally horizontal subset 310 of pads 130 is arranged along a path that is a parallel curve of the upper peripheral edge 146, and the second generally horizontal subset 318 of pads 130 is arranged along a path this is a parallel curve of the lower peripheral edge 150. In the embodiment illustrated, a third generally horizontal subset 326 of pads 130 is disposed along a third generally horizontally-extending path 306*c* that is disposed between the first generally horizontally-extending path 306*a* and the second generally horizontally-extending path 306*b*. Alternative embodiments, may include any number of generally horizontally-extending paths. For example, some embodiments may include a face plate having pads disposed along a single generally horizontally-extending path. Some embodiments may include a plurality of pads disposed along four or more generally horizontally-extending paths. In some embodiments, generally horizontal subsets disposed above the longitudinal axis 84, i.e., within the crown region 78, may be arranged parallel to the upper peripheral edge 146, whereas generally horizontal subsets disposed below the longitudinal axis 84, i.e., within the sole region 82, may be arranged parallel to the lower peripheral edge 150. In situations with an odd number of rows of pads, a centrally-disposed row may be disposed along and/or parallel to the longitudinal axis 84. Alternatively, the centrally-disposed row may be located generally equidistantly between the adjacent rows above and below it.

Still referring to FIG. 8, the boundary 162 of each pad 130 of the first generally horizontal subset 310 is also a function of the upper peripheral edge 146. More specifically, the boundaries 162 of the pads 130 of the first generally horizontal subset 310 include upper boundary line segments 166*a* and lower boundary line segments 170*a*, which are also offset curves of the upper peripheral edge 146. For the sake of clarity, only the pad 130*b* is labeled with its boundary 162 including the upper boundary line segment 166*a* and the lower boundary line segment 170*a*; however, it should be understood that each pad 130 of the first generally horizontal subset 310, i.e., pads 130*a*-130*e* labeled in FIG. 6, includes each of these elements and its own center point 298. In the embodiment illustrated, the upper boundary line segments 166*a* of the pads 130 of the first generally horizontal subset 310 are coincident with a first upper generally horizontal line 338. The lower boundary line segments 170*a* of the pads 130 of the first generally horizontal subset 310 are similarly coincident along a first lower generally horizontal line 342. Both the first upper generally horizontal line 338 and the first lower generally horizontal line 342 are parallel offsets to the upper peripheral edge 146 and the first generally horizontally-extending path 306*a*. Because the first generally horizontally-extending path 306*a* extends through the center points 298 of each pad 130 of the first generally horizontal subset 310, the upper boundary line segments 166*a* and the lower boundary line segments 170*a* of the pads 130 of the first generally horizontal subset 310 may be substantially equally spaced from the first generally horizontally-extending path 306*a*. Correspondingly, the first upper generally horizontal line 338 and the first lower generally horizontal line 342 are equally spaced from the first generally horizontally-extending path 306*a* on opposing sides thereof.

Still referring to FIG. 8, the pads 130 of the second generally horizontal subset 318, i.e., pads 130*k*-130*o* shown in FIG. 6, are similarly designed so that the boundaries 162 thereof are functions of the contour of the lower peripheral edge 150. For the sake of clarity, again, only the pad 130*o* is labeled with its boundary 162 that includes an upper boundary line segment 166*b* and a lower boundary line segment 170*b*; however, it should be understood that each pad 130 of the second generally horizontal subset 318 includes each of these elements and the center point 298. The upper boundary line segments 166*b* and the lower boundary line segments 170*b* of the second generally horizontal subset 318 of pads 130 are offset curves to the lower peripheral edge 150. Furthermore, in the illustrated embodiment, the upper boundary line segments 166*b* of the pads 130 of the second generally horizontal subset 318 are coincident with a second upper generally horizontal line 346, and the lower boundary line segments 170*b* of the pads 130 of the second generally horizontal subset 318 are coincident with a second lower generally horizontal line 350. Both the second upper generally horizontal line 346 and the second lower generally horizontal line 350 are parallel offsets of the lower peripheral edge 150 and the second generally horizontally-extending path 306*b*. Because the second generally horizontally-extending path 306*b* extends through the center points 298 of each pad 130 of the second generally horizontal subset 318, the upper boundary line segments 166*b* and the lower boundary line segments 170*b* of the pads 130 of the second generally horizontal subset 318 may be equally spaced from the second generally horizontally-extending path 306*b*. Correspondingly, the second upper generally horizontal line 346 and the second lower generally horizontal line 350 are equally spaced from the second generally horizontally-extending path 306*b* on opposing sides thereof. Therefore, the upper and lower boundary lines 166*a*, 170*a* of the first generally horizontal subset 310 generally mimic the curvature of the upper peripheral edge 146, whereas the upper and lower boundary lines 166*b*, 170*b* of the second generally horizontal subset 318 generally mimic the curvature of the lower peripheral edge 150.

With continued reference to FIG. 8, the shape of the pads 130 of the third generally horizontal subset 326, i.e., the pads 130*k*-130*o*, is a function of a combination of the upper and lower peripheral edges 146, 150. More specifically, the boundaries 162 of the third generally horizontal subset 326 include upper boundary line segments 166*c* and lower boundary line segments 170*c*, which are parallel offsets of the upper peripheral edge 146 and the lower peripheral edge 150, respectively. In FIG. 8, only the pad 130*g* is labeled with its boundary 162 that includes the upper boundary line segment 166*c* and the lower boundary line segment 170*c*; however, it should be understood that each pad 130 of the third generally horizontal subset 326 includes each of these elements and the center point 298. The upper boundary line segments 166*c* of the third generally horizontal subset 326 extend along a third upper generally horizontal line 354, and the lower boundary line segments 170*c* of the third generally horizontal subset 326 extend along a third lower generally horizontal line 358, the third upper generally horizontal line 354 and the third lower generally horizontal line 358 being parallel offsets of the upper peripheral edge 146 and the lower peripheral edge 150, respectively. Accordingly, the upper boundary line segments 166*c* and the lower boundary line segments 170*c* of the pads 130 of the third generally horizontal subset 326 generally have opposing curvatures. Consequently, the pads 130 of the third generally horizontal subset 326 disposed proximate or within the toe region 74 and the heel region 66 may occupy a smaller area than the pads 130 disposed near or within the medial region 70 of the face plate 50. Because the upper and lower boundary line segments 166*c*, 170*c* of the pads 130 of the third generally horizontal subset 326 are respectively determined by the upper and lower peripheral edges 146, 150 of the face plate 50, the center points 298 of the pads 130 of the third subset 326 may be functions of a combination of the upper peripheral edge 146 and the lower peripheral edge 150.

In some embodiments, generally, upper and lower boundary line segments disposed substantially above the longitudinal axis 84 (see FIG. 6), i.e., within the crown region 78, may be functions of or parallel offsets to the upper peripheral edge 146, whereas the upper and lower boundary line segments disposed substantially below the longitudinal axis 84, i.e., within the sole region 82, may be functions of or parallel to the lower peripheral edge 150. Accordingly, in embodiments that have an odd number of generally horizontal subsets, the centrally disposed subset, such as the third generally horizontal subset 326 shown in FIG. 6, may have its upper boundary line segments and lower boundary line segments disposed substantially above and below the longitudinal axis 84, respectively, and, accordingly, the curvature of the upper boundary line segments and the lower boundary line segments may be determined by the upper peripheral edge 146 and the lower peripheral edge 150, respectively.

Figure 9:
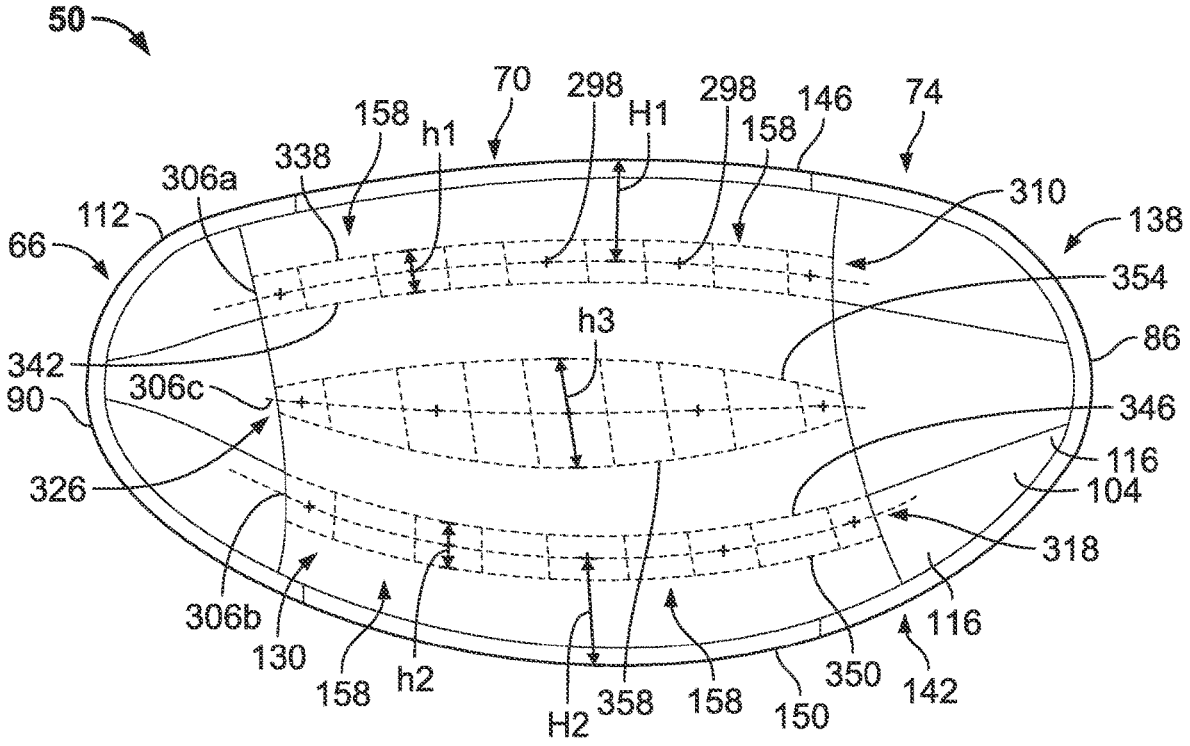
FIG. 9 is still another rear elevational view of the face plate of FIG. 6.

Turning to FIG. 9, a height of each of the pads 130 may be an adjustable parameter according to the CT measurement map. For example, a height h1 of the pads 130 of the first generally horizontal subset 310, which may be measured between the first upper generally horizontal line 338 and the first lower generally horizontal line 342 perpendicularly thereto, may be between about 1 mm and about 10 mm. In some embodiments, the height h1 may be between about 3 mm and about 5 mm. Similarly, a height h2 of the pads 130 of the second generally horizontal subset 318, which may be measured between the second upper generally horizontal line 346 and the second lower generally horizontal line 350 perpendicularly thereto, may be between about 2 mm and about 10 mm. Further, in some embodiments, the height h2 may be between about 3 mm and about 5 mm. Moreover, a height h3, which may correspond to the height of one of the pads 130 of the third generally horizontal subset 326, may also vary between face plate designs. In the embodiment illustrated, the height h3 corresponds to a maximum height of a centrally disposed pad 130. In some embodiments, the height h3 may be between about 4 mm and about 14 mm. In some aspects, the height h3 may be between about 8 mm and about 10 mm. Because the shapes of the pads 130 of the third generally horizontal subset 326 are determined by the upper peripheral edge 146 and the lower peripheral edge 150, the height of each of the pads 130 of the third generally horizontal subset 326 may also be a function of the upper and lower peripheral edge 146, 150 curvatures in combination with the height h3 and the generally horizontal spacing of each pad, which will be described in greater detail below.

Generally, the heights of each of the pads 130 are generally configured to be controlled according to the CT measurement map. That is, depending on desired CT measurements, algorithms may calculate heights required to achieve the desired CT measurements at particular locations.

In addition to the height of each pad 130, vertical spacing between the generally horizontal subsets 310, 318, 326 may also be an adjustable parameter. For example, still referring to FIG. 9, in some embodiments, each of the generally horizontal subsets 310, 318, 326 may be vertically distributed according to particular patterns. In such instances, the generally horizontally-extending paths 306*a*, 306*b*, 306*c* may additionally be vertically distributed according to the particular patterns. For example, referring to the illustrated embodiment, the first generally horizontal subset 310 may be spaced from the upper peripheral edge 146 by a first distance H1, which may be measured normal to the first generally horizontally-extending path 306*a* and the upper peripheral edge 146. Similarly, the second generally horizontal subset 318 may be equally spaced from the lower peripheral edge 150 by a second distance H2, which may be measured normal to the second generally horizontally-extending path 306*b* and the lower peripheral edge 150. In some embodiments, the first distance H1 and the second distance H2 may be substantially equal. However, in some embodiments, the first distance H1 may differ from the second distance H2. For example, the first distance H1 may be greater than or less than the second distance H2. Further, the third generally horizontal subset 326 may be centrally disposed, i.e., evenly spaced, between the first generally horizontal subset 310 and the second generally horizontal subset 318 in some embodiments. Alternatively, the third generally horizontal subset 326 may not be centrally disposed between the first generally horizontal subset 310 and the second generally horizontal subset 318. For example, in some embodiments, the third generally horizontal subset 326 and, accordingly, the third generally horizontally-extending path 306*c* may be closer to the first generally horizontal subset 310 than the second generally horizontal subset 318. Alternatively, in some embodiments, the third generally horizontal subset 326 and, accordingly, the third generally horizontally-extending path 306*c* may be closer to the second generally horizontal subset 318 than the first generally horizontal subset 310. Generally, similar to other dimensional parameters of the internal surface design, the vertical spacing of each of the generally horizontally-extending pads 306*a*, 306*b*, 306*c* is configured to be controlled according to the CT measurement map. That is, depending on desired CT measurements, algorithms may be used to determine a preferred vertical spacing between each of the generally horizontal subsets 310, 318, 326 and the peripheral edges 146, 150 necessary to achieve one or more desired CT measurements at particular locations on the face plate 50.

Figure 10:
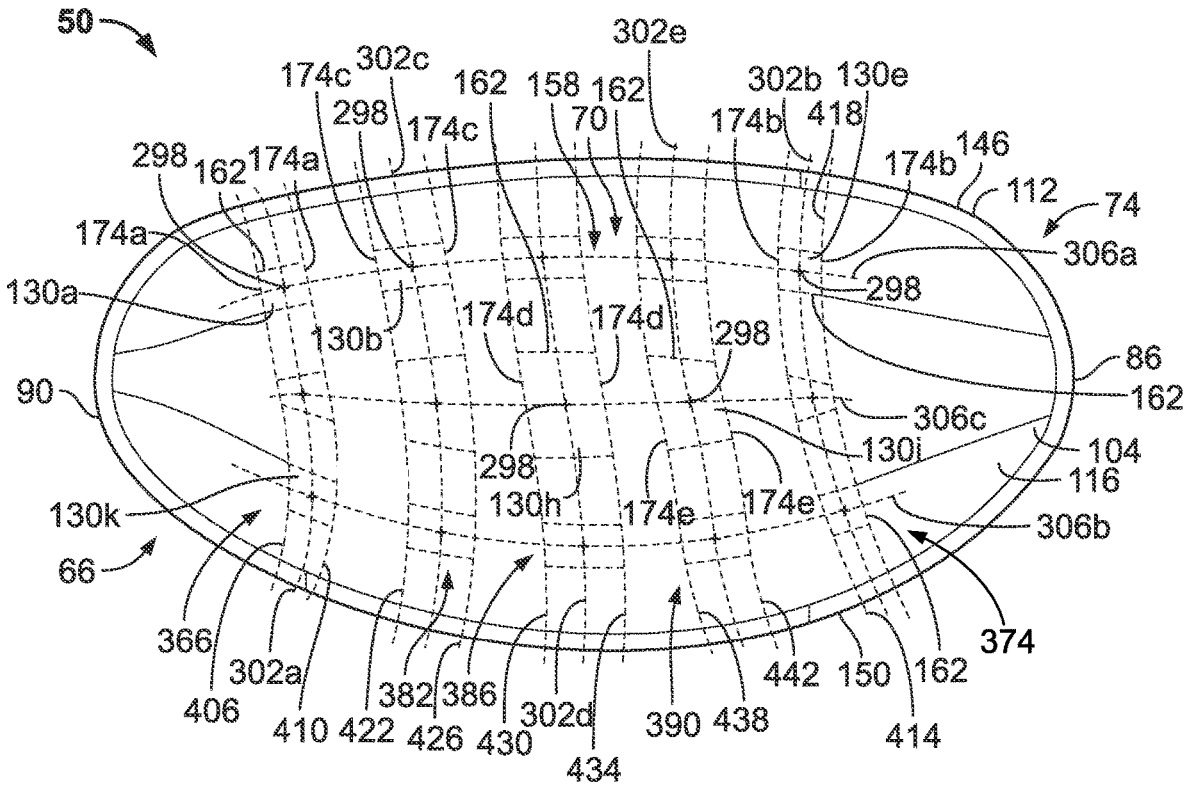
FIG. 10 is yet another rear elevational view of the face plate of FIG. 6.

Now referring to FIG. 10, as mentioned above, the plurality of pads 130 may also be arranged so that their center points 298 are disposed along at least one generally vertically-extending path. For example, a first generally vertical subset 366, which may comprise the pads 130*a*, 130*f*, 130*k* as shown in FIG. 6, is disposed along a first generally vertically-extending path 302*a* that is disposed proximate or within the heel region 66 of the face plate 50. The first generally vertically-extending path 302*a* is disposed radially inwardly from the distal heel end 90 and extends between the upper peripheral edge 146 and the lower peripheral edge 150. Further, the first generally vertically-extending path 302*a* may curve so that it intersects both the upper peripheral edge 146 and the lower peripheral edge 150 substantially normal thereto. That is, the first generally vertically-extending path 302*a* may extend substantially perpendicularly from the upper peripheral edge 146 before extending and curving toward the lower peripheral edge 150 so that it intersects the lower peripheral edge 150 substantially perpendicularly. Similarly, a second generally vertical subset 374, which may include the pads 130*e*, 130*j*, 130*o* as shown in FIG. 6, may be disposed along a second generally vertically-extending path 302*b* that is disposed proximate or within the toe region 74 of the face plate 50 and is disposed radially inwardly from the distal toe end 86. The second generally vertically-extending path 302*b* may similarly extend and curve so that it intersects the upper peripheral edge 146 and the lower peripheral edge 150 substantially normally. Therefore, in summary, the first generally vertical subset 366 may be arranged along a path that is normal to both the upper peripheral edge 146 and the lower peripheral edge 150, and the second generally vertical subset 374 may be similarly arranged along a path that is normal to both the upper peripheral edge 146 and the lower peripheral edge 150.

In some embodiments, the upper peripheral edge 146 and the lower peripheral edge 150 may influence the overall curvatures of the first and second generally vertically-extending paths 302*a*, 302*b*. For example, the positioning and curvature of the paths 302*a*, 302*b* may be influenced by the upper and lower peripheral edges 146, 150 depending on their proximity to the upper and/or lower peripheral edges 146, 150. Differently said, moving along the first generally vertically-extending path 302*a* from the lower peripheral edge 150 toward the upper peripheral edge 146, the influence of the lower peripheral edge 150 on the curvature of the first generally vertically-extending path 302*a* may weaken as the influence of the upper peripheral edge 146 may strengthen. Therefore, the curvature of portions of the first generally vertically-extending path 302*a* proximate the upper peripheral edge 146 may be influenced by the upper peripheral edge 146 more than the lower peripheral edge 150, and the curvature of portions of the first generally vertically-extending path 302*a* proximate the lower peripheral edge 150 may be influenced by the lower peripheral edge 150 more than the upper peripheral edge 146. While the discussion above only references the first generally vertically-extending path 302*a*, this curvature trend/relationship may be applicable to any of the generally vertically-extending paths 302*a*-302*e*. Further, alternative embodiments may include additional generally vertically-extending paths that exhibit this curvature trend.

In the illustrated embodiment, some of the plurality of pads 130 are disposed along additional generally vertical subsets 382, 386, 390 disposed between the first generally vertical subset 366 and the second generally vertical subset 374. While the illustrated embodiment includes a total of five generally vertical subsets 366, 374, 382, 386, 390, including the first generally vertical subset 366 and the second generally vertical subset 374, alternative embodiments may include more or fewer generally vertical subsets. For example, some embodiments may include a single generally vertical subset of pads, i.e., pads arranged in a single generally vertical column. Further, some embodiments may include two, three, four, six, or more generally vertical subsets. Each of the generally vertical subsets 382, 386, 390 are arranged similarly to the first generally vertical subset 366 and the second generally vertical subset 374. For example, each of the pads 130 of the subsets 382, 386, 390 are arranged so that their center points 298 are disposed on generally vertically-extending paths 302*c*, 302*d*, 302*e*, respectively, that are arranged to be normal to the upper peripheral edge 146 and the lower peripheral edge 150. That is, each generally vertically-extending path 302*c*, 302*d*, 302*e* may be normal to the lower peripheral edge 150 at the intersection point with the lower peripheral edge 150 before extending and curving so that it intersects the upper peripheral edge 146 perpendicularly. Therefore, the curvature and positioning of the generally vertically-extending paths 302*c*, 302*d*, 302*e* may be functions of the upper peripheral edge 146 and the lower peripheral edge 150.

Still referring to FIG. 10, the boundary 162 of each pad 130 of the first generally vertical subset 366 may also be a function of the upper peripheral edge 146 and the lower peripheral edge 150. More specifically, the boundaries 162 of the pads 130*a*, 130*f*, 130*k* (see FIG. 6) of the first generally vertical subset 366 include opposing lateral boundary line segments 174*a*, which are normal curves of the upper peripheral edge 146 and the lower peripheral edge 150. For purposes of clarity, only the pad 130*a* is labeled with its opposing lateral boundary line segments 174*a* in FIG. 10; however, each of the pads 130*a*, 130*f*, 130*k* of the first generally vertical subset 366, which are labeled in FIG. 6, include opposing lateral boundary line segments 174*a*. With continued reference to FIG. 10, in the embodiment illustrated, the opposing lateral boundary line segments 174*a* of the first generally vertical subset 366 are coincident with a pair of generally vertical reference lines 406, 410 that are normal curves to the upper peripheral edge 146 and the lower peripheral edge 150. Further, the generally vertical reference lines 406, 410 may be parallel curves of the first generally vertically-extending path 302*a*. Because the first generally vertically-extending path 302*a* extends through the center points 298 of each pad 130 of the first generally vertical subset 366, the opposing lateral boundary line segments 174*a* of the first generally vertical subset 366 may be equally spaced from the first generally vertically-extending path 302*a*. Correspondingly, the pair of generally vertical reference lines 406, 410 may be equally spaced from the first generally vertically-extending path 302*a* on opposing sides thereof.

The pads 130 of the second generally vertical subset 374 are similarly designed so that the boundaries 162 thereof are functions of the upper peripheral edge 146 and the lower peripheral edge 150. Particularly, boundaries 162 of the pads 130*e*, 130*j*, 130*o* (see FIG. 6) of the second generally vertical subset 374 include opposing lateral boundary line segments 174*b* that are perpendicular curves to the upper peripheral edge 146 and the lower peripheral edge 150. Again, for purposes of clarity, only the pad 130*e* is labeled with its opposing lateral boundary line segments 174*b* in FIG. 10; however, it should be understood that each of pads 130*e*, 130*j*, 130*o* labeled in FIG. 6 include opposing lateral boundary line segments 174*b*. Furthermore, in the illustrated embodiment, the opposing lateral boundary line segments 174*b* of the second generally vertical subset 374 are coincident with generally vertical reference lines 414, 418 that are normal curves of the upper peripheral edge 146 and the lower peripheral edge 150. Thus, the generally vertical reference lines 414, 418 may be parallel curves of the second generally vertically-extending path 302*b*. Moreover, because the second generally vertically-extending path 302*b* extends through the center points 298 of each pad 130 of the second generally vertical subset 374, the opposing lateral boundary line segments 174*b* may be equally spaced from the second generally vertically-extending path 302*b*. Correspondingly, the generally vertical reference lines 414, 418 may be equally spaced from the second generally vertically-extending path 302*b* on opposing sides thereof. This pattern may generally apply to the additional generally vertical subsets 382, 386, 390. For example, the boundaries 162 each of the generally vertical subsets 382, 386, 390 respectively include opposing lateral boundary line segments 174*c*, 174*d*, 174*e* that are also coincident with generally vertical reference lines that are normal curves to the upper peripheral edge 146 and the lower peripheral edge 150. More specifically, the opposing lateral boundary line segments 174*c* of the pads 130*b*, 130*g*, 130*l* (see FIG. 6) of the generally vertical subset 382 may extend along a pair of generally vertical reference lines 422, 426. The opposing lateral boundary line segments 174*d* of the pads 130*c*, 130*h*, 130*m* (see FIG. 6) of the generally vertical subset 386 may extend along a pair of generally vertical reference lines 430, 434. Similarly, the opposing lateral boundary line segments 174*e* of the pads 130*d*, 130*i*, 130*n* (see FIG. 6) of the generally vertical subset 390 may extend along generally vertical reference lines 438, 442. Therefore, in summary, the opposing lateral boundary line segments 174*c*, 174*d*, 174*e* of each generally vertical subset 382, 386, 390, respectively, may generally mimic the curvature of the respective generally vertically-extending path 302*c*, 302*d*, 302*e* and may be functions of the curvature and other dimensions of the upper peripheral edge 146 and the lower peripheral edge 150. In FIG. 10, only pads 103*b*, 130*h*, 130*i* from generally vertical subsets 382, 386, 390 are labeled with the opposing lateral boundary line segments 174*c*, 174*d*, 174*e*, respectively, but each of the pads of the generally vertical subsets 382, 386, 390, which are labeled in FIG. 6, includes the opposing lateral boundary line segments 174*c*, 174*d*, 174*e*, respectively.

Figure 11:
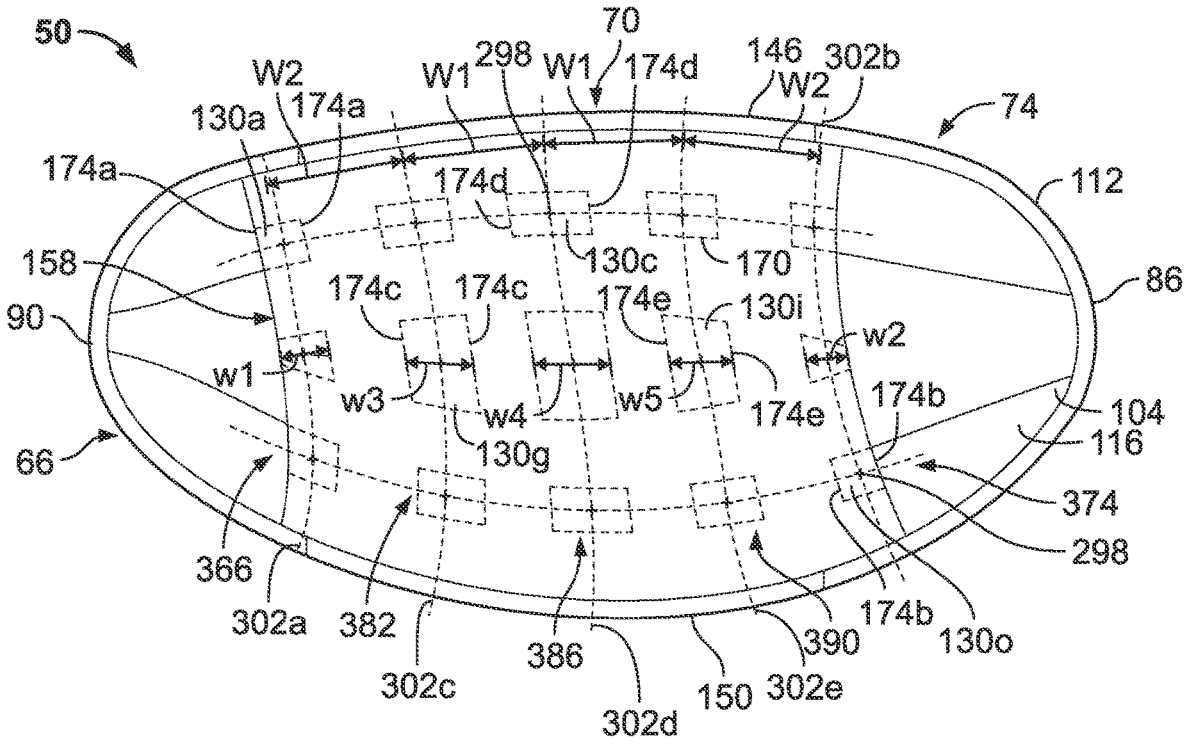
FIG. 11 is another rear elevational view of the face plate of FIG. 6.

Turning to FIG. 11, similar to the height of each pad 130, a width of each of the pads 130 may be an adjustable parameter according to the CT measurement map, the width being measured between the respective opposing lateral boundary line segments 174*a*-174*e* through the respective center point 298. For example, a width w1 of the pads 130 of the first generally vertical subset 366, which is measured between the opposing lateral boundary line segments 174*a*, may be between about 2 mm and about 10 mm. In some aspects, the width w1 may be between about 3 mm and about 6 mm. Similarly, a width w2 of the pads 130 of the second generally vertical subset 374, which is measured between the opposing lateral boundary lines segments 174*b*, may be between about 2 mm and about 10 mm. Further, in some aspects, the width w2 may be between about 3 mm and about 6 mm. Moreover, the generally vertical subset 382 may have a width w3, which may be between about 2 mm and about 14 mm. In some embodiments, the width w3 may be between about 4 mm and about 6 mm. Additionally or alternatively, the generally vertical subset 386 may have a width w4, which may be between about 5 mm and about 8 mm, and the generally vertical subset 390 may have a width w5, which may be between about 4 mm and about 7 mm. In some embodiments, each of the generally vertical subsets 366, 374, 382, 386, 390 may have substantially equal widths. Alternatively, in some embodiments, the widths may differ. For example, pad widths may increase moving toward a center or sweet spot of the club face from the heel and toe ends. As such, the width w1 and the width w2 of the first generally vertical subset 366 and the second generally vertical subset 374, respectively, may be substantially equal, while the widths w3, w4, w5 of the generally vertical subsets 382, 386, 390 may be greater, with the width w4 at the center being larger still than each of w3 and w5. Alternatively, the width w1 and the width w2 of the first generally vertical subset 366 and the second generally vertical subset 374, respectively, may be greater than the widths w3, w4, w5 of the centrally-disposed generally vertical subsets 382, 386, 390. In some embodiments, the widths of the generally vertical subsets 382, 386, 390 may gradually increase from proximate the toe region 74 to proximate the heel region 66. Further, in some embodiments, the widths may gradually decrease from proximate the toe region 74 to proximate the heel region 66. Generally, similar to other parameters of the internal surface design, the widths of each of the pads 130 may be configured to be controlled according to the CT measurement map. That is, depending on desired CT measurements, algorithms may be used to adjust widths of the pads 130 to achieve desired CT measurements at particular locations.

In addition to the width of each pad 130, the horizontal spacing between the generally vertical subsets 366, 374, 382, 386, 390 may also be an adjustable parameter, the horizontal spacing being measured between the generally vertically-extending paths 302*a*, 302*b*, 302*c*, 302*d*, 302*e*. For example, still referring to FIG. 11, in some embodiments, each of the generally vertical subsets 366, 374, 382, 386, 390 may be substantially equally spaced horizontally. In such instances, the generally vertically-extending paths 302*a*-302*e* may additionally be substantially equally spaced apart horizontally. However, in some embodiments, one or more of the horizontal spacings may differ. For example, referring to the embodiment illustrated, each of the generally vertical subsets 382, 386, 390 may be equally spaced in series by a first distance W1, whereas the first generally vertical subset 366 and the second generally vertical subset 374 may be spaced from the subsets 382, 390 by a second distance W2, which may be greater than or less than the first distance W1. In one aspect, spacing between the generally vertical subsets of pads may increase from the heel and toe ends toward the center of the club face or may decrease from those ends toward the center. In other embodiments, the spacing between each generally vertical subset 382, 386, 390 may gradually increase from proximate the toe region 74 to proximate the heel region 66. Alternatively, in still other embodiments, the spacing between each generally vertical subset 382, 386, 390 may gradually decrease from proximate the toe region 74 to proximate the heel region 66. Generally, any combination of spacing configuration between each of the generally vertical subsets 366, 374, 382, 386, 390 is possible. Moreover, similar to other parameters of the internal surface design, the distribution/spacing of the generally vertical subsets 366, 374, 382, 386, 390 is generally configured to be controlled according to the CT measurement map. That is, depending on desired CT measurements, algorithms may distribute the generally vertical subsets 366, 374, 382, 386, 390 accordingly to achieve desired CT measurements at particular locations.

Any of the above-mentioned design parameters, e.g., quantity of pads, number of generally vertical subsets, number of generally horizontal subsets, curvature of the peripheral edge, vertical spacing of pads, horizontal spacing of pads, curvature of internal surface within transition region, etc., may be determined by way of a variety of methods. For example, the quantity of pads may be determined via trial and error. That is, in response to results from one or more analyses, such as FEA, the number of pads may be deliberately increased or decreased to influence stress distribution about the face plate. Similarly, in response to tests that determine estimated or actual characteristic time measurements across a face plate, quantity and/or arrangement of the pads may be adjusted to modify the characteristic time measurements. Therefore, the quantity of pads may be iteratively adjusted to achieve an enhanced face plate design. Additionally or alternatively, arrangement and distribution of the pads may be determined using equations or algorithms that are configured to determine design parameters required to achieve specific results. More specifically, if a user wants to decrease a characteristic time measurement at a particular location, algorithms may adjust distribution of the pads to enhance the face plate design and to minimize negative changes to characteristic time measurements and/or stress distributions across the face plate. Moreover, the curvature of the paths that the pads are disposed along, e.g., the generally vertically-extending paths 302*a*-302*e* and/or the generally horizontally-extending paths 306*a*-306*c* shown in FIG. 10, may be determined using equations or algorithms as well. For example, when (or as) the alignment of a subset of the pads are changed, either by a user or via computer algorithms, the curvatures of the remaining pads may be autonomously adjusted to achieve particular design characteristics and/or establish an enhanced face plate design.

In summary, embodiments of the present disclosure may provide a face plate with one or more pads, or regions of constant thickness, that are correlated with CT measurements on the face plate. As discussed in detail above, the one or more pads may be designed cohesively so that design parameters thereof, such as, e.g., number of pads, positioning of pads, size of the pads, etc., are selected to achieve particular performance results, such as, e.g., particular characteristic time measurements. Additionally, other parameters, such as, e.g., the vertical and horizontal alignment of the one or more pads, may be cooperative. For example, the outer peripheral edge of the face plate may control the horizontal and/or vertical alignment of the pads. Therefore, the designs of the one or more pads are each coordinated with each other, the overall face plate design, and desired performance parameters.

Figure 12:
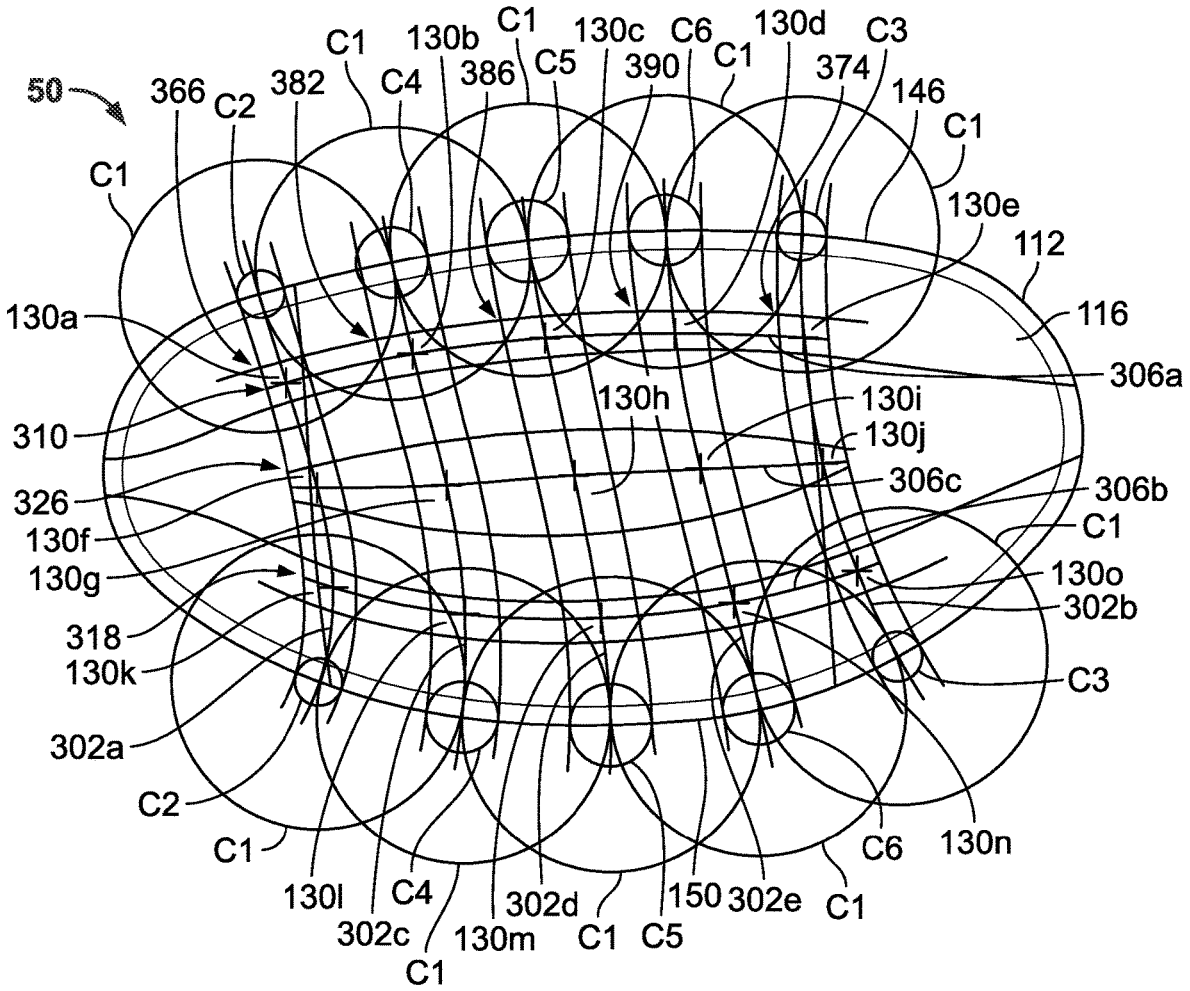
FIG. 12 is a rear view of the face plate of FIG. 4 identifying relationships between various elements disposed on the face plate.

FIG. 12 illustrates a schematic view of the face plate 50 that summarizes the relationships of the design parameters discussed above. FIG. 12 shows each of the pads 130*a*-130*o* arranged along the generally vertically-extending paths 302*a*-302*e* and the generally horizontally-extending paths 306*a*-306*c*. In the illustrated schematic, the spacing of each of the generally vertically extending paths 302*a*-302*e* is shown by the radius of reference circle C1. Because C1 is the spacing between each of the generally vertically-extending paths 302*a*-302*e*, each of the vertically-extending paths 302*a*-302*e* are substantially equally distributed. Therefore, increasing the radius of C1 would collectively increase the spacing between each of the generally vertically-extending paths 302*a*-302*e*. However, the spacing of the generally vertically-extending paths 302*a*-302*e* may be variable in alternative embodiments.

Still referring to FIG. 12, the width of each of the pads 130*a*-130*o* is shown using reference circles C2-C6. More specifically, the reference circle C2 corresponds to the width of the pads 130*a*, 130*f*, 130*k* of the first generally vertical subset 366, whereas the reference circle C3 corresponds to the width of the pads 130*e*, 130*j*, 130*o* of the second generally vertical subset 374. Adjusting the radius of C2 would correspondingly change the width of the pads 130*a*, 130*f*, 130*k* of the first generally vertical subset 366. Likewise, adjusting the radius of C3 would adjust the width of the pads 130*e*, 130*j*, 130*o* of the second generally vertical subset 374. This trend is applicable to the remaining generally vertical subsets 382, 386, 390. For example, adjusting the radius of reference circle C4 would change the width of the pads 130*b*, 130*g*, 130*l* of the generally vertical subset 382. Adjusting the radius of reference circle C5 would change the width of pads 130*c*, 130, h, 130*m* of the generally vertical subset 386. Correspondingly, adjusting the radius of reference circle C6 would change the width of pads 130*d*, 130*i*, 130*n* of the generally vertical subset 390.

The schematic shown in FIG. 12 may be particularly useful when designing face plates according to embodiments of the present disclosure. For example, a graphical user interface may display a model similar to the schematic shown in FIG. 12 to a user during the design process. Therefore, a user may selectively modify one or more parameters on the model to influence performance parameters of the face plate, and the model may update according to parameter selections.

In another aspect, the internal surface 116 of the face plate 50 may include one or more score lines in addition to the pads discussed above. The one or more score lines may be laser etched, CNC milled, or formed using any other technique understood by one of ordinary skill in the art. The score lines may extend generally horizontally and/or generally parallel to the rows of pads. Additionally or alternatively, the score lines may extend generally vertically and/or generally parallel to the columns of pads. Additionally or alternatively, the score lines may be angled relative to a horizontal and/or to the rows of pads. In one aspect, score lines may be generally linear or curvilinear. In another aspect, score lines may be periodic, zig-zag, or have a non-uniform shape. Further, in some aspects, the score lines may traverse entirely across the face plate 50 so that both ends of the score line intersect the outer peripheral edge 112. For example, a score line may extend from the upper peripheral edge 146 to the lower peripheral edge 150. Additionally or alternatively, one or more score lines may traverse only a portion of the plate. For example, a score lines may be configured so that only one end thereof intersects the outer peripheral edge 112. In some aspects, score lines may not intersect the outer peripheral edge 112 at all. Moreover, the score lines need not traverse across the entire interior surface 116, i.e., from one edge to an opposing edge. Rather, in some aspects, a score line may curve so that both ends thereof intersect the upper peripheral edge 146. Likewise, a score line may curve so that both ends thereof intersect the lower peripheral edge 150.

One or more score lines may overlap one or more of the pads and/or rows and/or columns of pads. Additionally or alternatively, one or more score lines may be disposed between rows and/or columns of pads. Additionally or alternatively, one or more score lines may meander around pads, e.g., extending above one pad in a row of pads and below an adjacent pad in the same row, while traversing the row in the space between the adjacent pads, or extending to the left of one pad in a column of pads and to the right of an adjacent pad in the same column, while traversing the column in the space between those adjacent pads. Preferably, each score line has a height that is smaller than a minimum height of the pads. Thus, in the case where the score line overlaps a pad, a row of pads, or a column of pads, the score line may be disposed entirely within the height of the pad(s).

Each score line also may include a depth extending in a direction between the interior surface 116 and the external surface 120. A maximum score line depth may be less than a minimum thickness of any of the pads. Alternatively, a maximum score line depth may be less than a thickness of any of the pads that it overlaps or to which it is adjacent, although it may be deeper than a depth of one or more other pads on the interior surface 116.

Score lines may have a generally rectangular cross-section when viewed perpendicular to their lengths. The score lines may include alternative cross-sectional shapes, such as rectangular, triangular or wedge-shaped, semi-circular, straight-sided with a rounded base, etc. In one aspect, all score lines on the interior surface 116 may have the same cross-sectional shape. In another aspect, the interior surface 116 may include score lines having two or more different cross-sectional shapes including, but not limited to, two or more of the shapes identified above.

Score lines may have substantially constant depths along their lengths. Alternatively, score lines may be shallower proximate one or both of their ends and get progressively deeper when extending toward a center of the club face or toward one or more points disposed between the ends. Alternatively, one or more of the score lines may have a depth that varies along its depth. For example, deeper portions of the score lines may be in the regions overlying one or more of the pads. Alternatively, deeper portions of the score lines may be in the regions disposed between one or more of the pads. In still another alternative, the varying depth may be unrelated to the locations of the pads. For example, the depth may vary periodically, e.g., in a wave-like pattern. Alternatively, changes in depth may be made in response to FEA results of the club face, with deeper or shallower portions of the score lines being located proximate regions of increased or decreased characteristic time and/or increased or decreased stress concentration.

The club face also may include one or more thickened portions adjacent to one or both edges of at least parts of one or more of the score lines, where the thickened portions are distinct from a thickness formed by or attributable to one or more of the pads. Thickened portions may be convexly or concavely shaped or linearly or otherwise shaped so as to form a ramp surface between the score line edge(s) and the adjacent portions of the interior surface 116 of the club face. Thickened portions may be generally uniformly shaped along their lengths. Alternatively, thickened portions may have smaller or larger cross-sections proximate one or both of their ends and get progressively larger or smaller, respectively, when extending toward a center of the club face or toward one or more points disposed between the ends. Alternatively, one or more of the thickened portions may have a cross-section that varies along its length. For example, larger portions of the thickened portions may be in the regions overlying one or more of the pads. Alternatively, larger portions of the thickened portions may be in the regions disposed between one or more of the pads. In still another alternative, the varying thickness may be unrelated to the locations of the pads. For example, the thickness may vary periodically, e.g., in a wave-like pattern. Alternatively, changes in thickness may be made in response to FEA results of the club face, with thicker or thinner portions of the thickened portions being located proximate regions of increased or decreased characteristic time and/or increased or decreased stress concentration.

The discussion above of a multi-thickness club face for a driver or similar metal wood similarly may apply to iron-type golf clubs. One of ordinary skill in the art would appreciate that the inner club faces of both types of clubs share many of the same characteristics, such as being defined by a heel end, a toe end, a sole or bottom end and an upper or top end, where the top end in the metal wood is adjacent a crown of the club and the top end of the iron is adjacent a topline.

Figure 13:
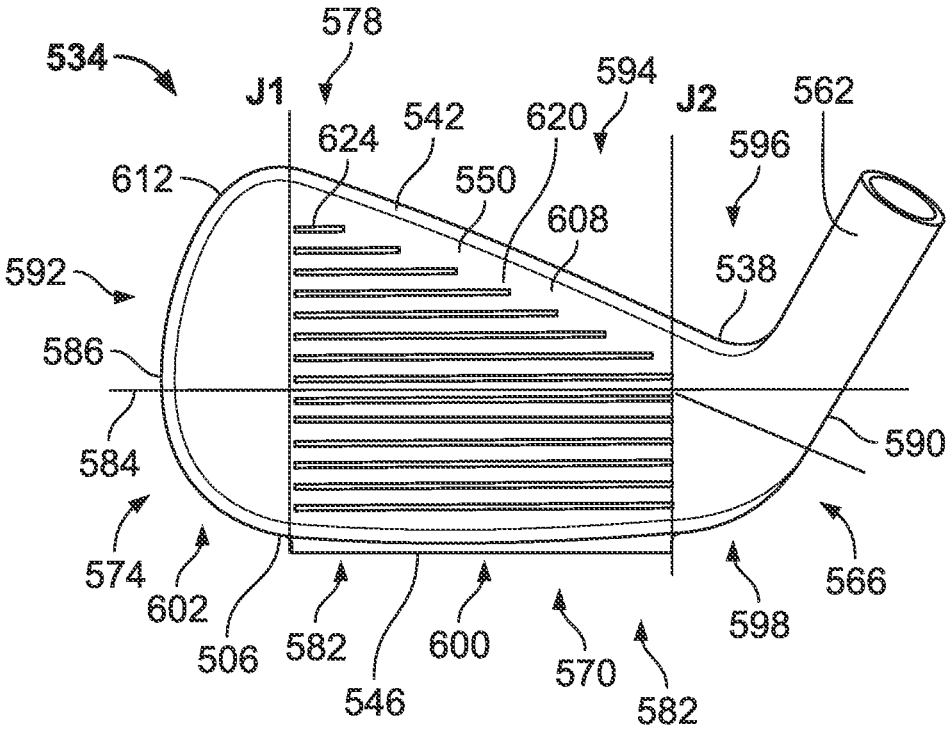
FIG. 13 is a front elevational view of another club head including a face plate in accordance with aspects of the present disclosure.

Referring now to FIG. 13, a front view of an iron-type golf club head 534 is shown, the iron-type golf club head 534 comprising a body 538 having a top line 542, a sole 546, and a multi-thickness face plate 550 according to aspects of the present disclosure. Further, the body 538 may define an interior cavity and varying regions of the iron-type golf club head 534. A hosel 562 is disposed within a heel region 566. A medial region 570 is disposed adjacent the heel region 566, the medial region 570 being disposed between the heel region 566 and a toe region 574. The toe region 574 is shown opposite the heel region 566.

FIG. 13 particularly highlights the face plate 550 and varying regions of the iron-type golf club head 534 that are illustrated with a coordinate system overlaid thereon. The heel region 566, the medial region 570, and the toe region 574 may be defined by lines J1 and J2, which extend over the face plate 550 of the iron-type golf club head 534. The iron-type golf club head 534 may further define a top line region 578 and a sole region 582, which may also be referred to as an upper region and a lower region, respectively. The top line region 578 and the sole region 582 may be defined by a longitudinal axis 584 that extends between a distal toe end 586 of the toe region 574 and a distal heel end 590 of the heel region 566 so that it extends along a longest length of the face plate 550. The longitudinal axis 584 may define a horizontal direction that runs parallel to the longitudinal axis 584. Correspondingly, a vertical direction is defined perpendicular to the longitudinal axis 584.

The lines J1, J2 and the longitudinal axis 584 define a grid that comprises two rows and three columns, i.e., an m×n grid where m and n are 3 and 2, respectively. The grid defines six sub-regions 592, 594, 596, 598, 600, 602, each of which is disposed in one of the heel region 566, the toe region 574, or the medial region 570 and one of the top line region 578 or the sole region 582. While all of the sub-regions are not specifically referenced herein, each location along the face plate 550 defines a coordinate that can be considered to be disposed within a sub-region defined by two of the regions 566, 570, 574, 578, 582. For example, the hosel 562 is located within the heel region 566 and the top line region 578, and may be referred to as being disposed within the upper, heel sub-region 596 of the face plate 550. Further, for example, the sub-region 602 is disposed within the toe region 574 and the sole region 582. Therefore, it should be noted that the various sub-regions are defined by the intersections of the regions 566, 570, 574, 578, 582 disclosed herein. The following disclosure may describe varying configurations or positions of regions of constant thickness, also referred to as pads, with reference to the grid overlaid upon the face plate 550 of the club head 534 depicted in FIG. 13. Note, the foregoing descriptions of the pads with respect to the face plate 50 are also applicable to the face plate 550 of the iron-type golf club head 534.

Figure 14:
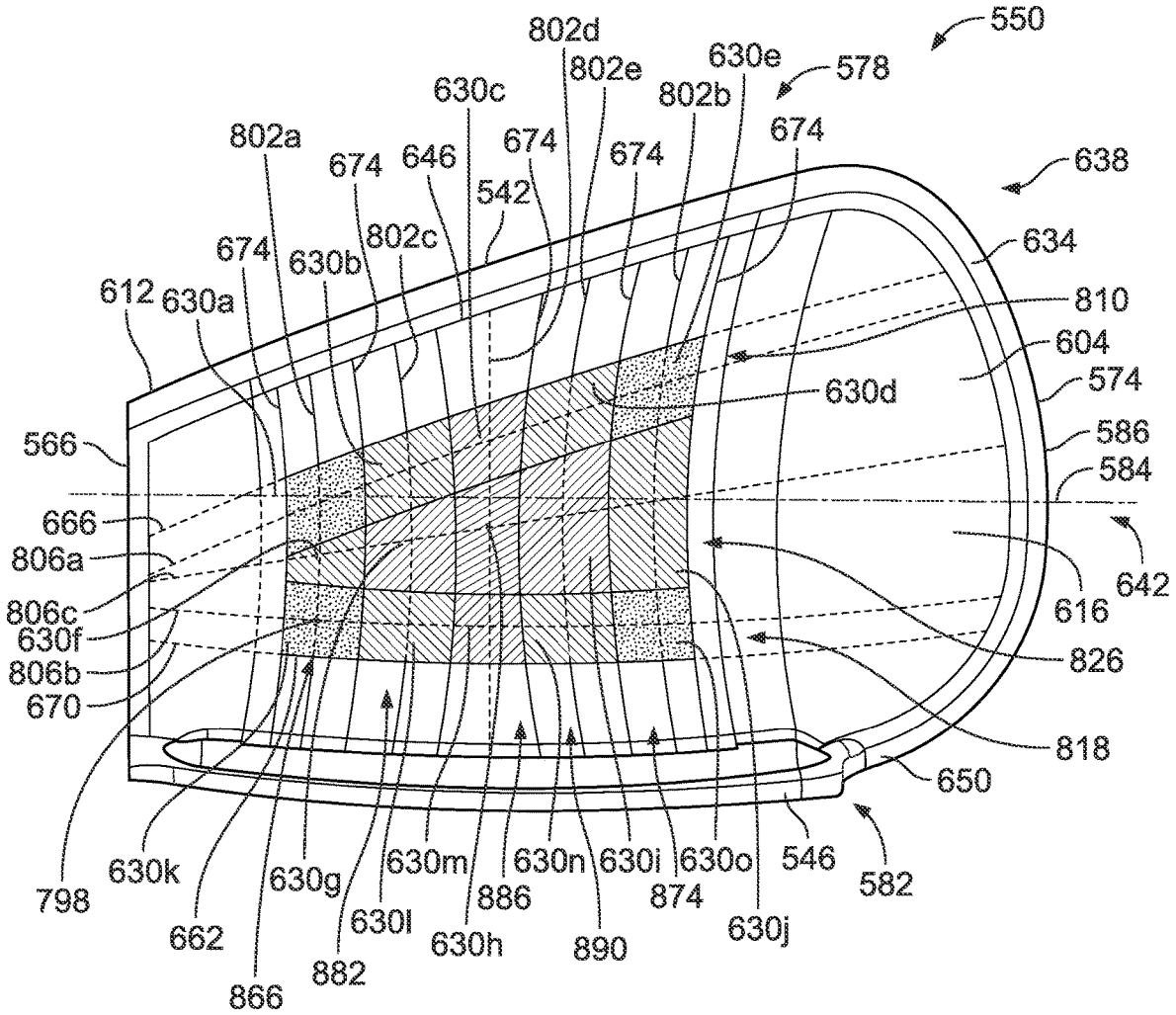
FIG. 14 is a rear elevational view of the face plate of FIG. 13.

As discussed above, the present disclosure may provide a face plate and systems and methods of adjusting CT measurements at discrete locations or regions on the face plate by modifying a variety of dimensional parameters associated with an internal surface design of the face plate. For example, FIG. 14 illustrates the face plate 550 according to an embodiment of the present disclosure configured for use in a golf club head, such as the iron-type golf club head 534 of FIG. 13. The face plate 550 may generally define a substantially plate-like article comprising a first side 604 (see FIG. 14), an opposing second side 608 (see FIG. 13), and an outer peripheral edge 612. In the illustrated embodiment, and referring particularly to FIG. 14, the first side 604 defines an internal surface 616 and is generally configured to project toward an interior cavity of a golf club head when installed therein. Accordingly, the opposing second side 608 (see FIG. 13) defines an external surface 620, which is configured to be visible from an exterior of the golf club head. In some embodiments, as shown in FIG. 13, the external surface 620 may include one or more grooves 624 that can impart rotation, i.e., spin, to a ball upon impact with the external surface 620.

As illustrated in FIG. 14, the internal surface 616 of the face plate 550 includes a plurality of pads 630. As noted above, the discussion of the plurality of pads 130 of the face plate 50, as illustrated in FIGS. 6-12, is applicable to the plurality of pads 630 of the face plate 550 depicted in FIG. 14. Accordingly, the plurality of pads 630 are generally regions of constant thickness, although these pads 630 may also be referred to as regions of variable thickness (as compared to other pads), regions of increased thickness (as compared to a nominal thickness of the face plate or a thickness of the peripheral edge), or regions of adjustable thickness (as compared to either other pads or the nominal thickness of the face plate). In the embodiment illustrated, for purposes of description only, the pads 630 are sequentially labeled with a letter, e.g., pads 630*a*-pads 630*o*, although it should be understood that the face plate 550 may include more or fewer pads than those shown in FIG. 14. Generally, these pads 630 are portions of the face plate 550 having defined and/or constant thicknesses.

The discussion of "thickness" described above in connection with FIG. 7A is incorporated herein, with thickness being a measurement taken perpendicularly between the internal surface 616 and the external surface 620. Each pad 630*a-o* defined by the internal surface 616 may be offset of the external surface 620 and, thus, they may exhibit the same curvature as its corresponding region of the external surface 620. Therefore, the thickness is measured between the internal surface 616 and the external surface 620 along a path that is substantially normal to the surfaces 616, 620, an example of which is shown by line 134 in FIG. 7A.

Referring to FIG. 14, according to some embodiments, the pads 630 may be distributed across the face in a q×r grid-like pattern. Particularly, in the embodiment illustrated, fifteen pads 630 are distributed so that they define a 5×3 grid pattern. Again, for purposes of description, each of the plurality of pads 630 is labeled alphanumerically from 630*a* to 630*o*. Alternative embodiments may include more or fewer pads disposed in a variety of patterns. For example, face plates according to alternative embodiments may include 12 pads distributed in a 4×3 pattern, 8 pads arranged in a 4×2 pattern, or 20 pads arranged in a 5×4 pattern. While there are benefits to distributing the pads in a substantially symmetrical pattern like the pads 630 shown in FIG. 14, symmetry is not necessary. Furthermore, while the pads 630 may be distributed over a minority of the internal surface 616, e.g., less than 50% of the internal surface 616, the pads may occupy more than 50% of the internal surface in alternative embodiments. Consequently, the disclosure is not limited to the number and configuration of pads illustrated herein.

Referring particularly to FIG. 14, the longitudinal axis 584 divides the face plate 550 into an upper region 638 and a lower region 642, the upper region 638 configured to be disposed proximate a top line of a golf club head, and the lower region 642 configured to be disposed proximate a sole of a golf club head when the face plate 550 is installed therein. Accordingly, the upper region 638 generally occupies the top line region 578 and the lower region 642 occupies the sole region 582. Correspondingly, the longitudinal axis 584 may divide the peripheral edge 634 into an upper peripheral edge 646 and a lower peripheral edge 650 that are associated with the upper region 638 and the lower region 642, respectively. The upper peripheral edge 646 thus may be configured to contact or couple to a golf club head at, proximate, or adjacent the top line 542 (see FIG. 13), whereas the lower peripheral edge 650 is configured to contact or couple to a golf club head at, proximate, or adjacent the sole 546 (see FIG. 13) thereof. The peripheral edge 634 comprising the upper peripheral edge 638 and the lower peripheral edge 634 is a generally curved edge that may be substantially free of discontinuities. That is, the peripheral edge 634 is a generally smooth edge that circumscribes a majority of the face plate 550. The curvature of the peripheral edge 634 may influence and/or be used to determine a curvature and positioning of the pads, which will be described in greater detail herein. Each of the upper peripheral edge 642 and the lower peripheral edge 650 further include a vertically extending portion that occupies the heel region 566 and spans between the upper region 638 and the lower region 642.

Still referring to FIG. 14, the plurality of pads 630 are distributed along the internal surface 616 of the face plate 550. However, in other aspects, the plurality of pads 630 are similar and may be similarly described as the plurality of pads 130. Although the pads 630 in the golf club head 534 of FIGS. 13 and 14 are depicted as being adjacent to or abutting one another, it also will be understood that the pads 630 may be separated from one another by one or more transition regions, such as the regions described above and shown in FIGS. 1-11. Each of the pads 630 may be defined by an enclosed boundary 662, which is shown using dashed reference lines in FIG. 14. The boundary 662 may comprise multiple linear or curvilinear boundary line segments connected together. In the embodiment illustrated, each boundary 662 includes an upper boundary line segment 666 and a lower boundary line segment 670 connected by opposing lateral boundary line segments 674, which may also be referred to as side boundary line segments. For the purpose of clarity, the figure only includes the enclosed boundary 662 labeled for a select pad 630*k*; however, it should be understood that each pad 630 includes a boundary 662 having an upper boundary line segment 666, a lower boundary line segment 670, and opposing lateral boundary line segments 674, as shown in FIG. 14. The boundary 662 of each pad 630 represents a junction between that pad and the surrounding pads. Thus, the boundary line segments 662, 666, 670 may define the locations at which the internal surface 616 of the face plate 550 transitions between one or more of the pads 630.

Referring to FIG. 14, as discussed above, the plurality of pads 630 may be arranged in a grid-like pattern. For example, in the illustrated embodiment, the pads 630 are arranged along a plurality of generally vertically-extending and generally horizontally-extending paths. More specifically, each pad 630 includes a center point 798, which is labeled in FIG. 14 only for pad 630*k* but will be understood as being representative for each pad 630. The center point 798 is substantially centrally disposed relative to the respective boundary 662, and the pads 630 are arranged so that a plurality of pads have their center points 798 disposed along at least one generally vertically-extending path and at least one generally horizontally-extending path. A first generally horizontal subset 810 of pads 630, particularly, is disposed along a first generally horizontally-extending path 806*a* that is disposed proximate the upper peripheral edge 646. The first generally horizontally-extending path 806*a* is disposed inwardly from the upper peripheral edge 646. Further, the first generally horizontally-extending path 806*a* may be substantially parallel to the upper peripheral edge 646. That is, the locations of the pad centers 798 of the first generally horizontally-extending path 806*a* may be a function of the upper peripheral edge 646 so that it is an offset curve of the upper peripheral edge 646. Thus, the center points 798 of each of the pads 630 of the first generally horizontal subset 810 may be substantially equidistant from the upper peripheral edge 646.

Similarly, a second generally horizontal subset 818 of pads 630 may have their centers 798 be disposed along a second generally horizontally-extending path 806*b* that is disposed proximate the lower peripheral edge 650 and is disposed radially inwardly from the lower peripheral edge 650. The second generally horizontally-extending path 806*b* may similarly be an offset curve of the lower peripheral edge 650. Therefore, the first generally horizontal subset 810 of pads 630 is arranged along a path that is a parallel curve of the upper peripheral edge 646, and the second generally horizontal subset 818 of pads 630 is arranged along a path this is a parallel curve of the lower peripheral edge 650. In the embodiment illustrated, a third generally horizontal subset 826 of pads 630 is disposed along a third generally horizontally-extending path 806*c* that is disposed between the first generally horizontally-extending path 806*a* and the second generally horizontally-extending path 806*b*. Alternative embodiments, may include any number of generally horizontally-extending paths. For example, some embodiments may include a face plate having pads disposed along a single generally horizontally-extending path. Some embodiments may include a plurality of pads disposed along four or more generally horizontally-extending paths. In some embodiments, generally horizontal subsets disposed above the longitudinal axis 584, i.e., within the top line region 578, may be arranged parallel to the upper peripheral edge 646, whereas generally horizontal subsets disposed below the longitudinal axis 584, i.e., within the sole region 582, may be arranged parallel to the lower peripheral edge 650. In situations with an odd number of rows of pads, a centrally-disposed row may be disposed along and/or parallel to the longitudinal axis 584. Alternatively, the centrally-disposed row may be located generally equidistantly between the adjacent rows above and below it.

Still referring to FIG. 14, the boundary 662 of each pad 630 of the first generally horizontal subset 810 is also a function of the upper peripheral edge 646. More specifically, the boundaries 662 of the pads 630 of the first generally horizontal subset 810 include upper boundary line segments and lower boundary line segments, which are also offset curves of the upper peripheral edge 646. In addition, the pads 630 of the second generally horizontal subset 818, i.e., pads 630*k*-630*o* shown in FIG. 14, are similarly designed so that the boundaries 662 thereof are functions of the contour of the lower peripheral edge 650. Further, the third generally horizontal subset 826 includes pads 630*f*-630*j* shown in FIG. 14, are similarly designed so that the boundaries 662 thereof are functions of the contour of both the lower peripheral edge 650 and the upper peripheral edge 646. In the illustrated embodiment, the third horizontally-extending path 806*c* is disposed at an incline angle relative to the longitudinal axis 584 and substantially parallel with the curvature of the top line 646 between the opposing boundary line segments 674. As such, the third generally horizontal subset 826 is designed so that the shape of the pads 630*f*-630*j* are functions of the top line 646 and the sole 650, respectively In some embodiments, generally, upper and lower boundary line segments disposed above the longitudinal axis 584 (see FIG. 14), i.e., within the top line region 578, may be functions of or parallel offsets to the upper peripheral edge 646, whereas the upper and lower boundary line segments disposed below the longitudinal axis 584, i.e., within the sole region 582, may be functions of or parallel to the lower peripheral edge 650. Accordingly, in embodiments that have an odd number of generally horizontal subsets, the centrally disposed subset, such as the third generally horizontal subset 826 shown in FIG. 14, may have its upper boundary line segments and lower boundary line segments disposed substantially above and below the longitudinal axis 584, respectively, and, accordingly, the curvature of the upper boundary line segments and the lower boundary line segments may be determined by the upper peripheral edge 646 and the lower peripheral edge 650, respectively.

In the illustrated embodiment, some of the plurality of pads 630 are disposed along generally vertical subsets 882, 886, 890 disposed between the first generally vertical subset 866 and the second generally vertical subset 874. While the illustrated embodiment includes a total of five generally vertical subsets 866, 874, 882, 886, 890, including the first generally vertical subset 866 and the second generally vertical subset 874, alternative embodiments may include more or fewer generally vertical subsets. For example, some embodiments may include a single generally vertical subset of pads, i.e., pads arranged in a single generally vertical column. Further, some embodiments may include two, three, four, six, or more generally vertical subsets. Each of the generally vertical subsets 882, 886, 890 are arranged similarly to the first generally vertical subset 866 and the second generally vertical subset 874. For example, each of the pads 630 of the subsets 882, 886, 890 are arranged so that their center points 798 are disposed on generally vertically-extending paths 802*c*, 802*d*, 802*e*, respectively, that are arranged to be substantially normal to the upper peripheral edge 646 and the lower peripheral edge 650. That is, each generally vertically-extending path 802*c*, 802*d* 802*e* may be normal to the lower peripheral edge 650 at the intersection point with the lower peripheral edge 650 before extending and curving so that it intersects the upper peripheral edge 646 at an angle, the angle being substantially 90 degrees for the generally vertically extending paths 802*a* and 802*c*. As illustrated in FIG. 14, the generally vertically-extending path 802*d* extends substantially perpendicular to the longitudinal axis 584 and, thus, does not curve in the upper region 638 or the lower region 642 as do the generally vertically-extending paths 802*c* and 802*e*. In fact, the generally vertically-extending paths 802*c* and 802*e* each curve away from the generally vertically-extending path 802*d*. Therefore, the curvature and positioning of the generally vertically-extending paths 802*c*, 802*d*, 802*e* may be functions of the upper peripheral edge 646 and the lower peripheral edge 650, as well as functions of each other.

Similarly, the generally vertical subset 874, which may include the pads 630*e*, 630*j*, 630*o* as shown in FIG. 14, may be disposed along a second generally vertically-extending path 802*b* that is disposed proximate or within the toe region 574 of the face plate 50 and is disposed radially inwardly from the distal toe end 586. The second generally vertically-extending path 802*b* may similarly extend and curve so that it intersects the upper peripheral edge 646 and the lower peripheral edge 650 substantially normally. Therefore, in summary, the first generally vertical subset 866 may be arranged along a path that is normal to both the upper peripheral edge 646 and the lower peripheral edge 650, and the second generally vertical subset 874 may be similarly arranged along a path that is normal to both the upper peripheral edge 646 and the lower peripheral edge 650.

Still referring to FIG. 14, the boundary 662 of each pad 630 of the first generally vertical subset 866 may also be a function of the upper peripheral edge 646 and the lower peripheral edge 650. More specifically, the boundaries 662 of the pads 630*a*, 630*f*, 630*k* of the first generally vertical subset 866 include opposing lateral boundary line segments 674, which are substantially normal curves to the upper peripheral edge 646 and the lower peripheral edge 650. Further, the pads 630 of the second generally vertical subset 874 are designed so that the boundaries 662 thereof are functions of the upper peripheral edge 646 and the lower peripheral edge 650. Particularly, boundaries 662 of the pads 630*e*, 630*j*, 630*o* of the second generally vertical subset 874 include opposing lateral boundary line segments 674 that are curves forming angles, e.g., greater than or less than 90 degrees, to the upper peripheral edge 646 and the lower peripheral edge 650.

In addition, the pads 630 of the generally vertical subset 886 are designed so that the boundaries 662 thereof are functions of the upper peripheral edge 646 and the lower peripheral edge 650. Particularly, boundaries 662 of the pads 630*c*, 630*h*, 630*m* of the generally vertical subset 886 include opposing lateral boundary line segments 674 that are curves forming angles to the upper peripheral edge 646 and the lower peripheral edge 650. As illustrated in FIG. 14, the boundary line segment 674 of the generally vertical subset 886 located closer to the heel region 566, i.e., heelward of the generally vertically-extending path 802*c*, curves in the upper region 638 to intersect the upper peripheral edge 646 substantially perpendicularly. However, the opposing boundary line segment 674 of the generally vertical subset 886 located closer to the top region 574, i.e., toeward of the generally vertically extending path 802*c*, curves in the upper region 638 to intersect the upper peripheral edge 646 substantially at an angle therewith.

Further, the pads 630 of the generally vertical subset 890 are designed so that the boundaries 662 thereof are functions of the upper peripheral edge 646 and the lower peripheral edge 650. Particularly, the boundaries 662 of the pads 630*d*, 630*i*, 630*n* of the generally vertical subset 890 include opposing boundary line segments 674, which are curves forming angles, e.g., greater or less than 90 degrees, to the upper peripheral edge 646 and the lower peripheral edge 650.

For the sake of clarity and conciseness, it will be appreciated that the comprehensive discussion of the boundary line segments (e.g., upper lower, first, second, third, vertical, horizontal, etc.) in reference to at least FIGS. 8-10 depicting the face plate 50 is inclusive of and contemplates the pads 630 of the face plate 550 of FIG. 13. Furthermore, the discussion of region-specific subsets, boundary lines, paths, reference lines, distances, areas, and curvatures, among other aspects, is incorporated herein as being applicable to and inclusive of the face plate 550.

Any of the above-mentioned design parameters, e.g., quantity of pads, number of generally vertical subsets, number of generally horizontal subsets, curvature of the peripheral edge, vertical spacing of pads, horizontal spacing of pads, curvature of internal surface within transition region, etc., may be determined by way of a variety of methods. For example, the quantity of pads may be determined via trial and error. That is, in response to results from one or more analyses, such as FEA, the number of pads may be deliberately increased or decreased to influence stress distribution about the face plate. Similarly, in response to tests that determine estimated or actual characteristic time measurements across a face plate, quantity and/or arrangement of the pads may be adjusted to modify the characteristic time measurements. Therefore, the quantity of pads may be iteratively adjusted to achieve an enhanced face plate design. Additionally or alternatively, arrangement and distribution of the pads may be determined using equations or algorithms that are configured to determine design parameters required to achieve specific results. More specifically, if a user wants to increase a characteristic time measurement at a particular location, algorithms may adjust distribution of the pads to enhance the face plate design and to minimize negative changes to characteristic time measurements and/or stress distributions across the face plate. Moreover, the curvature of the paths that the pads are disposed along, e.g., the generally vertically-extending paths 302*a*-302*e* and/or the generally horizontally-extending paths 306*a*-306*c* shown in FIG. 10, may be determined using equations or algorithms as well. For example, when (or as) the alignment of a subset of the pads are changed, either by a user or via computer algorithms, the curvatures of the remaining pads may be autonomously adjusted to achieve particular design characteristics and/or establish an enhanced face plate design.

In summary, embodiments of the present disclosure may provide a face plate with one or more pads, or regions of constant thickness, that are correlated with CT measurements on the face plate. As discussed in detail above, the one or more pads may be designed cohesively so that design parameters thereof, such as, e.g., number of pads, positioning of pads, size of the pads, etc., are selected to achieve particular performance results, such as, e.g., particular characteristic time measurements. Additionally, other parameters, such as, e.g., the vertical and horizontal alignment of the one or more pads, may be cooperative. For example, the outer peripheral edge of the face plate may control the horizontal and/or vertical alignment of the pads. Therefore, the designs of the one or more pads are each coordinated with each other, the overall face plate design, and desired performance parameters.

Any of the embodiments described herein may be modified to include any of the structures or methodologies disclosed in connection with different embodiments. Further, the present disclosure is not limited to golf clubs of the type specifically shown. Still further, aspects of the golf club heads and weighting systems of any of the embodiments disclosed herein may be modified to work with any type of golf club.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the disclosure are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the same. The exclusive rights to all modifications which come within the scope of the appended claims are reserved.

We claim:

1. A variable thickness face plate for a golf club head, the face plate including a longitudinal axis extending between a toe side and a heel side along a longest length of the face plate, the longitudinal axis dividing the face plate into an upper region and a lower region, the face plate comprising:

a peripheral edge including an upper peripheral edge and a lower peripheral edge, the upper peripheral edge and the lower peripheral edge being separated by the longitudinal axis, wherein the upper peripheral edge is configured to be adjacent a top of the golf club head when the face plate is installed, and wherein the lower peripheral edge is configured to be adjacent a sole of the golf club head when the face plate is installed; and a plurality of regions of generally constant thickness extending away from an internal surface of the face plate, the thickness being measured perpendicularly from the internal surface of the face plate, the plurality of regions of generally constant thickness including:

a first subset of regions of generally constant thickness being disposed along a first generally horizontally-extending path proximate the upper peripheral edge, the first generally horizontally-extending path being disposed radially inward from and parallel to the upper peripheral edge; and a second subset of regions of generally constant thickness being disposed along a second generally horizontally-extending path proximate the lower peripheral edge, the second generally horizontally-extending path being disposed radially inward from and parallel to the lower peripheral edge, wherein each of the plurality of regions of generally constant thickness is enclosed by a boundary edge extending from the internal surface of the face plate, wherein an upper portion of the boundary edge of the first subset of regions of generally constant thickness follows a curve that is offset with respect to the upper peripheral edge of the face plate, the curve substantially equally spaced from the upper peripheral edge along its length, wherein each of the first and second subsets of regions includes a toeward-most region and a heelward-most region, wherein the boundary edge of each toeward-most region includes a toe-facing side, wherein the boundary edge of each heelward-most region includes a heel-facing side, and wherein at least one of the toe-facing side of the boundary edge of each toeward-most region or the heel-facing side of the boundary edge of each heelward-most region is curved concavely when viewed from the toe or the heel toward a plane extending perpendicular to the longitudinal axis at a center of the face plate, respectively.

2. The variable thickness face plate of claim 1, wherein each of the plurality of regions of generally constant thickness includes a centrally disposed center point, wherein the center point of each of the regions of the first subset is disposed on the first generally horizontally-extending path, and wherein the center point of each of the regions of the second subset is disposed on the second generally horizontally-extending path.

3. The variable thickness face plate of claim 2, wherein a transition region exists between each of the plurality of regions of generally constant thickness, and wherein the internal surface of the face plate curves to gradually adjust the thickness of the face plate within the transition region.

4. The variable thickness face plate of claim 3, wherein, in the transition region, the internal surface of the face plate tangentially extends away from one of the plurality of regions of generally constant thickness, curves toward another of the plurality of regions of generally constant thickness to increase or decrease a thickness of the face plate, and tangentially transitions into the other of the regions of generally constant thickness or the peripheral edge of the face plate.

5. The variable thickness face plate of claim 4, wherein the boundary edge includes an upper boundary edge and a lower boundary edge connecting two opposing side boundary edges, wherein the toe-facing side and the heel-facing side of the toeward-most region and the heelward-most region comprise one of the two opposing side boundary edges of each toeward-most region and each heelward-most region, respectively, and wherein the boundary edge defines a junction between the respective region of generally constant thickness and the transition region surrounding the region of generally constant thickness.

6. The variable thickness face plate of claim 5, wherein the boundary edge defines the point at which the internal surface of the face plate tangentially transitions between the transition region and the respective region of generally constant thickness to change the thickness of the face plate.

7. The variable thickness face plate of claim 6, wherein the upper boundary edge and the lower boundary edge of each of the regions of the first subset are offset curves of the upper peripheral edge.

8. The variable thickness face plate of claim 7, wherein the upper boundary edge of the regions of the first subset are coincident along a first upper generally horizontal path that is an offset curve of the upper peripheral edge, and wherein the lower boundary edge of the regions of the first subset are coincident along a second upper generally horizontal path that is an offset curve of the upper peripheral edge.

9. The variable thickness face plate of claim 7, wherein the upper boundary edge and the lower boundary edge of each of the regions of the second subset are offset curves of the lower peripheral edge.

10. The variable thickness face plate of claim 9, wherein the upper boundary edge of the regions of the second subset are coincident along a first lower generally horizontal path that is an offset curve of the lower peripheral edge, and wherein the lower boundary edge of the regions of the second subset are coincident along a second lower generally horizontal path that is an offset curve of the lower peripheral edge.

11. The variable thickness face plate of claim 5, wherein each of the regions of the first subset is aligned with one of the regions of the second subset such that their center points are disposed on a common vertically-extending path.

12. The variable thickness face plate of claim 11, wherein the generally vertically-extending path intersects the upper peripheral edge normally, and wherein the generally vertically-extending path intersects the lower peripheral edge normally.

13. The variable thickness face plate of claim 12, wherein each of the generally vertically-extending paths intersects the upper peripheral edge at an upper intersection point, and wherein the upper intersection points are equally spaced along the upper peripheral edge.

14. The variable thickness face plate of claim 13, wherein the two opposing side boundary edges of each of the regions of generally constant thickness are equidistant from the center point of the respective region of generally constant thickness, and wherein the two opposing side boundary edge are offset curves of the respective generally vertically-extending path.

15. The variable thickness face plate of claim 14, wherein the opposing side boundary edges of the aligned regions of the first subset and the second subset are coincident along a generally vertically-oriented path that is a parallel curve of the respective generally vertically-extending path.

16. The variable thickness face plate of claim 15, wherein the plurality of regions of generally constant thickness further includes:

a third subset of regions of generally constant thickness being disposed along a third generally horizontally-extending path disposed between the first generally horizontally-extending path and the second generally horizontally-extending path, wherein each of the regions of generally constant thickness of the third subset is aligned with one of the generally vertically-extending paths.

17. The variable thickness face plate of claim 5, wherein the top is a top line.

18. The variable thickness face plate of claim 1, wherein the top is a crown.

19. A variable thickness face plate for a golf club head, the face plate includes a longitudinal axis extending between a toe side and a heel side along a longest length of the face plate, the longitudinal axis dividing the face plate into an upper region and a lower region, the face plate comprising:

a peripheral edge comprising an upper peripheral edge and a lower peripheral edge, the upper peripheral edge and the lower peripheral edge being separated by the longitudinal axis, wherein the upper peripheral edge is configured to be adjacent a top of the golf club head when the face plate is installed, and wherein the lower peripheral edge is configured to be adjacent a sole of the golf club head when the face plate is installed; and a plurality of pads extending away from an internal surface of the face plate, the plurality of pads being regions of pre-set thickness, the thickness being measured perpendicularly from the internal surface of the face plate, wherein a transition region exists between each of the plurality of pads, the internal surface of the face plate curving to adjust the thickness of the face plate within the transition region so that the pads are smoothly connected by the transition region, and wherein each of the plurality of pads is defined by an enclosed boundary edge comprising an upper boundary edge and a lower boundary edge connecting a toe-facing boundary edge and a heel-facing boundary edge, the enclosed boundary edge defining a junction between the respective pad and the transition region surrounding the pad, wherein the plurality of pads includes a toeward-most pad and a heelward-most pad, wherein at least one of the toe-facing boundary edge of the toeward-most pad or the heel-facing boundary edge of the heelward-most pad is curved concavely when viewed from the toe side or the heel side, respectively, toward a plane extending perpendicular to the longitudinal axis at a center of the face plate, wherein each of the plurality of pads is thicker than a nominal thickness of the face plate that is measured perpendicularly from the internal surface of the face plate at the peripheral edge thereof, and wherein the internal surface defines a concave curve in a plane defined as being parallel to the longitudinal axis and extending in the same direction as the nominal thickness of the face plate, the curve extending in the transition region to an inflection point before transitioning to a convex curve extending from the inflection point to the enclosed boundary edge to define a rounded edge.

20. The variable thickness face plate of claim 19, wherein the top is a crown, and wherein the plurality of pads includes:

a first subset of pads being disposed along a first generally horizontally-extending path proximate the upper peripheral edge, the first generally horizontally-extending path being disposed radially inward from and parallel to the upper peripheral edge.

21. The variable thickness face plate of claim 20, wherein the upper boundary edge and the lower boundary edge of each of the regions of the first subset are parallel curves of the upper peripheral edge.

22. The variable thickness face plate of claim 21, wherein the plurality of pads further includes:

a second subset of pads being disposed along a second generally horizontally-extending path proximate the lower peripheral edge, the second generally horizontally-extending path being disposed radially inward from and parallel to the lower peripheral edge, wherein the upper boundary edge and the lower boundary edge of each of the regions of the second subset are offset curves of the lower peripheral edge.

23. The variable thickness face plate of claim 22, wherein each of the pads of the first subset is aligned with one of the pads of the second subset such that their center points are disposed on a common generally vertically-extending path, wherein the generally vertically-extending path intersects the upper peripheral edge and the lower peripheral edge perpendicularly.

24. The variable thickness face plate of claim 23, wherein the plurality of pads further includes:

a third subset of pads being disposed along a third generally horizontally-extending path disposed between the first generally horizontally-extending path and the second generally horizontally-extending path, wherein each of the pads of the third subset is aligned with one of the generally vertically-extending paths.

25. The variable thickness face plate of claim 19, wherein the top is a top line, and wherein the plurality of pads includes:

a first subset of pads being disposed along a first generally horizontally-extending path proximate the upper peripheral edge, the first generally horizontally-extending path being disposed radially inward from and parallel to the upper peripheral edge.

* * * * *